United States Patent [19]

Tutamune et al.

[11] Patent Number: 4,884,698

[45] Date of Patent: Dec. 5, 1989

[54] APPARATUS FOR HANDLING SHEETS OF PAPER

[75] Inventors: Hirotaka Tutamune; Yasuo Shiragai; Yoshiaki Karino; Yasuyuki Wakasa, all of Niigata, Japan

[73] Assignee: Hitachi, Ltd., Tokyo, Japan

[21] Appl. No.: 874,131

[22] Filed: Jun. 13, 1986

[30] Foreign Application Priority Data

| | | | |
|---|---|---|---|
| Jun. 17, 1985 | [JP] | Japan | 60-129822 |
| Jul. 5, 1985 | [JP] | Japan | 60-146505 |
| Sep. 10, 1985 | [JP] | Japan | 60-198433 |

[51] Int. Cl.[4] ..... B07C 5/38; G07D 7/00

[52] U.S. Cl. ..... 209/534; 209/551; 235/379; 902/12

[58] Field of Search ..... 209/539, 551; 194/205–207; 235/379; 271/3, 3.1, 4, 9, 157–159, 163, 296, 302; 364/478; 377/8; 414/37, 114, 120, 226; 901/6, 7; 902/12, 13

[56] References Cited

U.S. PATENT DOCUMENTS

| | | | |
|---|---|---|---|
| 3,168,644 | 2/1965 | Richardson et al. | 377/8 |
| 3,176,859 | 4/1965 | Prager | 414/114 |
| 3,759,382 | 9/1973 | Walkley et al. | 209/551 X |
| 3,868,044 | 2/1975 | Abe et al. | 271/9 X |
| 3,966,059 | 6/1976 | Sase | 414/114 |
| 4,017,004 | 4/1977 | Onoe et al. | 271/9 X |
| 4,262,817 | 4/1981 | Fish | 271/9 X |
| 4,365,700 | 12/1982 | Arimoto et al. . | |
| 4,465,193 | 8/1984 | Kokubo et al. | 209/534 |
| 4,620,087 | 10/1986 | Aizaki | 235/379 |
| 4,625,870 | 12/1986 | Nao et al. | 209/534 |
| 4,722,443 | 2/1988 | Maruyama et al. | 209/534 |

FOREIGN PATENT DOCUMENTS

| | | | |
|---|---|---|---|
| 2313294 | 12/1976 | France | 414/114 |
| 55-66453 | 5/1980 | Japan | 271/296 |
| 56-63664 | 5/1981 | Japan . | |
| 56-83875 | 7/1981 | Japan . | |
| 56-147258 | 11/1981 | Japan . | |
| 57-75371 | 5/1982 | Japan | 235/379 |
| 59-33590 | 2/1984 | Japan . | |
| 59-33757 | 2/1984 | Japan . | |
| 59-08685 | 11/1984 | Japan . | |
| 60-209870 | 10/1985 | Japan | 235/379 |

*Primary Examiner*—Johnny D. Cherry
*Assistant Examiner*—Edward M. Wacyra
*Attorney, Agent, or Firm*—Fay, Sharpe, Beall, Fagan, Minnich & McKee

[57] ABSTRACT

A conveying device is provided among an accommodating section for accommodating sheets of paper, a counting section for discriminating and counting the sheets of paper, and a port section through which the sheets of paper are put in and taken out of the apparatus, so as to deliver the sheets of paper to any of these components according to a transaction specified between discharge and deposit accepting transactions.

119 Claims, 14 Drawing Sheets

APPARATUS FOR HANDLING SHEETS OF PAPER

BACKGROUND OF THE INVENTION

The present invention relates to an apparatus for handling sheets of paper, and more particularly, to an apparatus for handling sheets of paper which is suitable for use in automated cash handling transactions involving depositing and drawing out bank notes.

FIG. 1 shows a known apparatus of this type. In the apparatus shown in FIG. 1, bank notes are taken out of an apparatus 30 (paid out) from a port section 36 in the following manner. The notes accommodated in cassettes 31, 32 are separated and counted at separating/accumulating sections 37, 38. The notes are then carried to the port section 36 one by one while being held by a belt 33 without being checked at a checking section 35. The notes are received from the port section (accepted as a deposit) in the following manner. The notes to be deposited which are placed at the port 36 are separated at a separating section 39, checked and counted at the checking section 35 while being held by the belt 33, and are accumulated in the cassettes 31, 32 by the separating/accumulating sections 37, 38.

In the apparatus described above, a large number of conveying routes need to be provided in a fixed manner by employing the belts 33 and rollers 34 between components including the cassettes 31, 32, the checking section 35 and the port section 36 in order to deliver the sheets of paper among these components. This increases the production cost of the conveying routes. Since these conveying routes are fixed, it is difficult to change their courses when modifying the specifications of the apparatus or expanding the functions thereof. In a case of changing them, much time and trouble are required to adjust the conveying routes. The papers are carried one by one in the apparatus, so that it takes much time to carry a large number of papers. This also increases the risk of paper being jammed at an intermediate point along the conveying routes. The apparatus uses separate paper separating/counting devices when the notes are deposited and drawn out. This increases the number of components and makes the mechanism complicated.

SUMMARY OF THE INVENTION

An object of the invention is to provide an apparatus for handling sheets of paper which is so improved as to have a simple structure by having separately formed units for each component.

Another object of the invention is to provide an apparatus for handling sheets of paper which allows for easy modification of specifications and expansion of functions.

An additional object of the invention is to provide an apparatus for handling sheets of paper which enables the paper conveying time to be reduced and the occurrence of paper jam in conveying routes to be reduced.

An apparatus for handling sheets of paper according to the present invention comprises a port section through which sheets of paper are discharged or accepted in the apparatus, a counting section for counting and checking the sheets of paper, an accommodating section for accommodating the sheets of paper, and a conveying device for transferring the sheets of paper between these plural components, wherein each of these components is made as a separately formed unit, and the conveying device is moved to any of the plural components while holding the sheets of paper.

In a preferred embodiment, the apparatus for handling sheets of paper includes at least an accommodating section for accommodating the sheets of paper, a counting section for discriminating and counting the sheets of paper and sorting the sheets of paper into those to be dealt with and those not to be dealt with, a port section through which the sheets of paper are taken out or put in, a conveying device for delivering the sheets of paper to and from each of the components when the sheets of paper are discharged, and a control section for controlling the conveying device, the port section and the counting section in accordance with a predetermined program. The conveying device has a hand section which grasps and releases the sheets of paper at a predetermined position relative to each component, and a transferring section for transferring the hand section to the predetermined position of each component. The hand section is adapted to take out en bloc a predetermined and suitable number of paper sheets in the accommodating section in a transaction involving the discharge of paper sheets.

In a further embodiment of the invention, the hand section is adapted to take out the paper sheets in the accommodating section in a number which is more than the maximum dischargeable number, in a number which is more than the average discharging number in one discharge, or in a number which is more than the number specified by a customer in a transaction involving the discharge of sheets of paper.

According to the present invention, the components are formed into separate units and constructed independently. This makes the structure of the apparatus simpler, while improving the quality thereof. Moreover, it is economical.

The operation of the conveying device is not fixed but is controlled by a controlling program, ensuring that modification of the specifications of the apparatus and expansion of the function scan be effected more freely.

The sheets of paper are transferred among the components en bloc. Therefore, only one transferring operation is required. The conveying device travels while it holds the sheets of paper. Therefore, the processing time is reduced, and the number of jams occurring during conveyance can be remarkably reduced.

DESCRIPTION OF THE PREFERRED EMBODIMENTS

Figure 1:
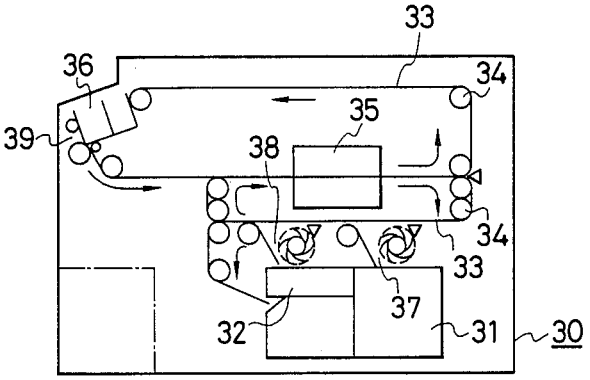
FIG. 1 PRIOR ART
FIG. 1 shows the configuration of a known example.

A first embodiment of the present invention will be described hereinunder with reference to FIGS. 2 to 4.

An apparatus for automatically conducting cash handling transactions of the first embodiment accepts one type of note (ten thousand yen notes, for example), and comprises an accommodating mechanism 1 for notes (accommodating section), a counting mechanism 2 (counting section), a port mechanism 3 (port section), a conveying device 4 (conveying section) and a control section 5.

A reader/writer of identification cards or magnetic cards which act as the media for a transaction, or keys operated by a customer (both not shown), are disposed above these components.

In the apparatus, the counting mechanism 2 is disposed above the note accommodating mechanism 1 and the control section 5, such that the counting mechanism 2 is stacked thereon, while these components are spaced apart from the port mechanism 3 by a predetermined interval L.

The conveying device 4 is disposed in the gap between the counting mechanism 2 and the port mechanism 3, so that it may deliver sheets of paper among each of those components 1, 2 and 3.

The accommodating mechanism 1 includes an upper half cashbox 1*a* and a lower half cashbox 1*b*, both accommodating notes to be used in a transaction involving the discharge of notes by having the notes stacked vertically. The cashboxes 1*a* and 1*b* respectively have a port 11 through which the notes are taken out of and put in the cashbox 1*a* and a retrieving port 12 through which those notes which are for some reason retrieved are received in the cashbox 1*b*. The accommodating mechanism 1 is provided at the rear of a supporting table 6.

The counting mechanism 2 is adapted, in the case of a paying transaction, to check the notes to be discharged, count them out to a number specified by a customer, and sort them into those to be dealt with and those not to be dealt with. In an accepting transaction, the counting mechanism 2 is adapted to check and count the notes deposited and separate them into valid and counterfeit notes.

Figure 3:
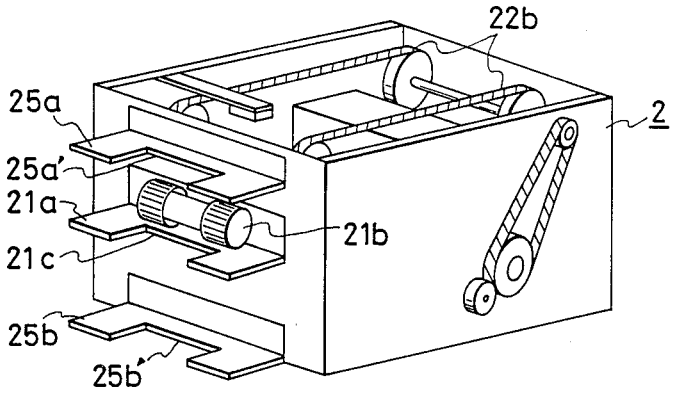
FIG. 3 is a perspective view of a counting section.
Figure 4:
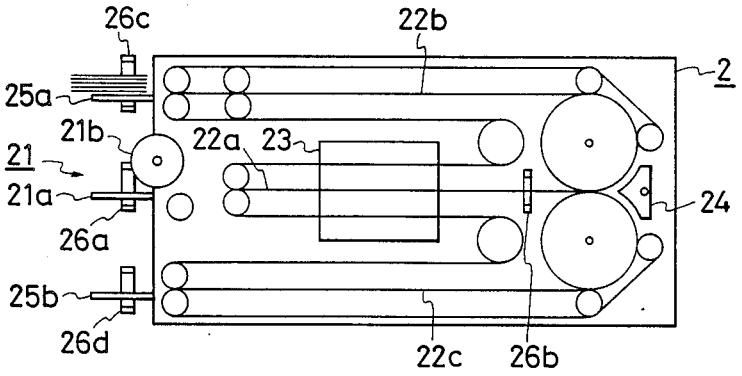
FIG. 4 is a sectional view of the counting section.

More specifically, the counting mechanism 2, as shown in FIGS. 3 and 4, includes a receiving section 21 for accepting the notes inside the counting mechanism 2, the receiving section 21 having a table or station 21*a* and a feed roller 21*b*; a main conveying passage 22*a* for carrying the received notes; conveying passages 22*b*, 22*c* provided at the exit side of the main conveying passage 22*a* and which are for conveying notes to be dealt with and those not to be dealt with, respectively, in a discharging transaction; a discriminator 23 for discriminating between notes to be dealt with and those not be dealt with and for counting the notes to be dealt with, the discriminator 23 being provided in the main conveying passage 22*a*; a gate 24 for sending the notes to the conveying passage 22*b* or conveying passage 22*c*, the gate 24 being provided between the main conveying passage 22*a* and the conveying passages 22*b*, 22*c*; stack sections or stations 25*a*, 25*b* for temporarily retaining the notes fed through the conveying passages 22*b* and 22*c*, respectively; a plurality of sensors 26*a* to 26*d*; and a case 27 for housing these components at their determined positions. It is to be noted that in a deposit accepting transaction the conveying passages 22*b*, 22*c* convey the notes not to be dealt with and those to be dealt with, respectively, and that the stack sections 25*a*, 25*b* are used accordingly.

The receiving section 21 and individual stack sections 25*a*, 25*b* are respectively disposed one above the other on the same side of the case 27, i.e., on the front side thereof.

In the counting mechanism 2, the notes which are placed on the table 21*a* of the receiving section 21 in a discharge transaction are detected by the sensor 26*a*, and are separately moved in the main conveying passage 22*a* one by one by means of the rotation of the feed roller 21*b*. The notes are then conveyed through the main conveying passage 22*a*. When they pass through the discriminator 23, the discriminator 23 differentiates notes to be dealt with from those not to be dealt with by determining whether the passing notes are valid or not and by detecting the extent to which each note is soiled. The gate 24 opens the passage to either conveying passage 22*b* or 22*c* when the sensor 26*b* detects the presence of the note discriminated, so that the notes to be dealt with and those not to be dealt with are appropriately introduced to the conveying passages 22*b* and 22*c*, respectively. Thus, the notes to be dealt with are then conveyed through the conveying passage 22*b*, and are detected by the sensor 26*c* so that a specified number of notes are retained on the stack section 25*a*. The notes not to be dealt with are conveyed through the conveying passage 22*c*, and are detected by the sensor 26*d* so that they are retained on the stack section 25*b*. If notes still remain on the table 21*a* when the specified number of notes are prepared on the stack section 25*a*, the remaining notes are sent to the stack section 25*b* through the main conveying passage 22*a* and the conveying passage 22*c*.

The port mechanism 3 has a port 3*a* through which the notes are taken out, and is disposed at the upper and front portion of the supporting table 6 in such a manner as to face the counting mechanism 2.

In the counting mechanism 2, the deposited notes which are placed on the table 21*a* of the receiving section 21 after being deposited by a customer in an accepting transaction are detected by the sensor 26*a*, and are accepted into the main conveying passage 22*a* one by one by means of the rotation of the feed roller 21*b*. The notes are then conveyed through the main conveying passage 22*a*. When they pass through the discriminator 23, the discriminator 23 differentiates notes to be dealt with from those not to be dealt with by determining whether the passing note is valid or not and by detecting the extent to which each note is soiled. The gate 24 opens the passage to either conveying passage 22*b* or 22*c* when the sensor 26*b* detects the presence of the discriminated note, so that the counterfeit or damaged notes, i.e., notes to be returned to the customer, and the valid notes, i.e., the notes to be received, are introduced to the conveyng passages 22*b* and 22*c*, respectively. The notes to be returned are conveyed through the conveying passage 22*b*, and are detected by the sensor 26*c* so that they are piled on the stack section 25*a*. The notes to be accepted are conveyed through the conveying passage 22*c*, and are detected by the sensor 26*d* so that they are piled on the stack section 25*b*.

The conveying device 4 is disposed on the supporting table 6 between the port mechanism 3 and the counting mechanism 2 and at the front of the accommodating mechanism 1, so as to distribute the notes among the port mechanism 3, counting mechanism 2 and accommodating mechanism 1. For that purpose, the conveying device 4 has, as shown in FIGS. 2 to 5, a hand section 41 for grasping and releasing the notes and a transferring section 42 for transferring the hand section 41 to any of a number of predetermined positions relative to the mechanisms 1, 2 and 3.

Figure 5:
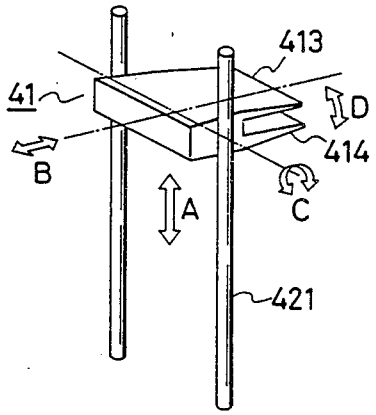
FIG. 5(*a*) and 5(*b*) are perspective views of a conveying section while FIG. 5(*c*) is a perspective view of an alternate embodiment of a conveying section.
Figure 5:
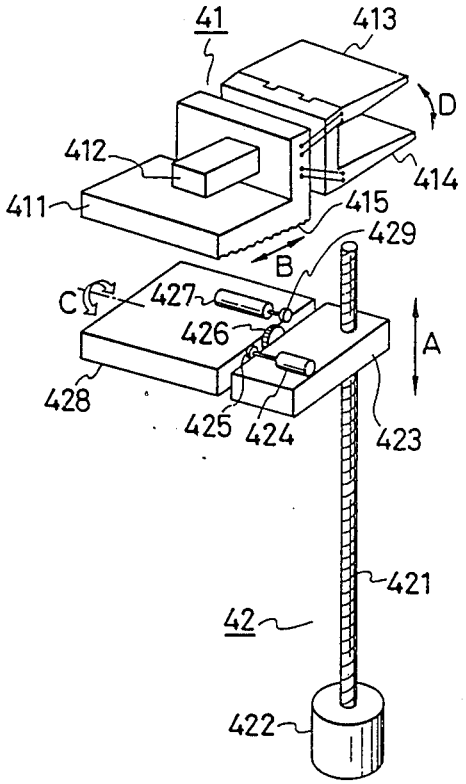
Figure 5:
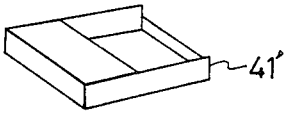

The hand section 41 shown in FIGS. 5(*a*) and 5(*b*) has a body 411 having a solenoid 412 for opening and closing fingers, and the body 411 is provided with a pair of fingers 413, 414 which open and close by means of the magnetic force of the solenoid 412 in the direction shown by the arrow D. The pair of fingers 413, 414 grasps the notes on being closed and releases the notes when opened.

The transferring section 42 has: a pair of screw shafts 421 provided vertically between the port mechanism 3 and counting mechanism 2/accommodating mechanism 1; a vertical motor 422 connected to the lower portion of each screw shaft 421; a supporting plate 423 threaded with each screw shaft 421, the supporting plate having a rotating motor 424; a sliding table 428 having a gear 426 provided at each side thereof which is threaded with a gear 425 mounted on the rotating shaft of the rotating motor 424, a central axis of the gear 426 being supported by the supporting plate 423, the sliding table 428 further having a horizontal motor 427 provided on the upper surface thereof; a pinion 429 mounted on the rotating shaft of the horizontal motor 427 and engaging with a rack 425 mounted on the body 411 of the hand section 41; and a retaining portion (not shown) for retaining the hand section 41 on the sliding table 428 in the state wherein the pinion 429 and the rack 415 are engaged with each other.

When the vertical motors 422 are driven so as to rotate the screw shafts 421, the supporting plates 423 and the sliding table 428 are moved in the direction shown by the arrow A, so that the hand section 41 is transferred in the same direction A. When the rotating motors 424 are driven and the gears 425 are rotated, the gears 426 engaging with the gears 425 are rotated around the gears 425 and the sliding table 428 is rotated around the rotating shaft of the rotating motor 424 in the direction shown by the arrow C, so that the hand section 41 is rotated in the same direction C. When the horizontal motor 427 is driven so as to rotate the pinion 429, the body 411 of the hand section is transferred by the rack 415 engaging with the pinion 429 in the direction shown by the arrow B, so that the hand section 41 is moved in the same direction B.

In the transferring device 4, when a discharging transaction is conducted, the hand section 41 takes out the notes in the accommodating mechanism 1, and is transferred to the counting mechanism 2 by the transferring section 42 so as to deliver the notes to the receiving section 21 of the counting mechanism 2. The hand section 41 then grasps from the stack section 25*a* those notes which were determined by the counting mechanism 2 to be notes to be dealt with, and is transferred to the port mechanism 3 by the transferring section 42 such as to deliver the notes to the port 3*a*. Subsequently, the hand section 41 grasps in the stack portion 25*b* the notes which were determined by the counting mechanism 2 to be notes not to be dealt with, and is transferred to the accommodating mechanism 1 by the transferring section 42 so as to deposit the notes not to be dealt with in the cashbox 1*a* of the accommodating mechanism 1.

Figure 2:
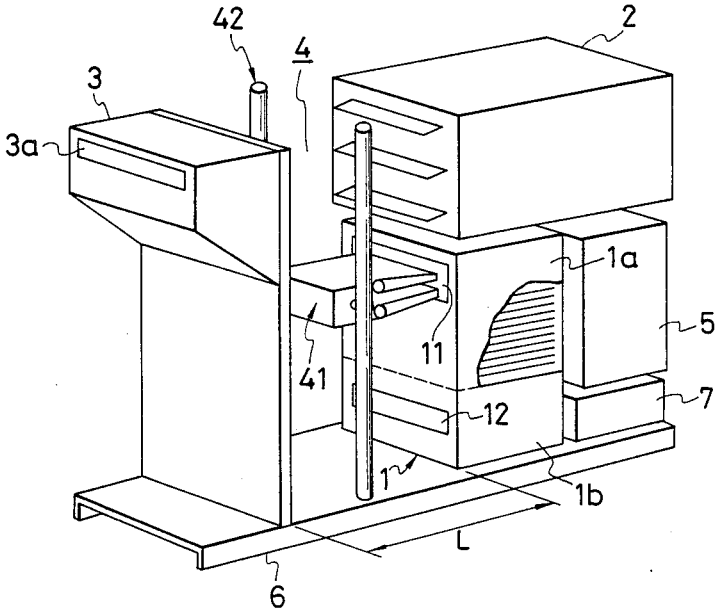
FIG. 2 is a perspective view of a first embodiment of an apparatus for handling sheets of paper according to the present invention, which is applied to automated cash handling transactions.

For these purposes, the table 21*a* of the receiving section 21 is provided with a notch 21*c* so that the hand section 41 can hand over the notes, as shown in FIG. 2. Also, the stack portions 25*a*, 25*b* are provided with notches 25'*a*, 25'*b*, respectively, so that the hand section 41 can grasp the notes retained thereon. The port 12 of the accommodating mechanism 1 has a size large enough to enable the hand section 41 to enter and to grasp and release the notes therein.

In the transferring mechanism 4, when a deposit accepting transaction is conducted, the hand section 41 takes out the notes in the port mechanism 3, and is transferred to the counting mechanism 2 by the transferring section 42 so as to deliver the notes to the receiving section 21 of the counting mechanism 2. The hand section then grasps in the stack portion 25*a* those notes which were determined by the counting mechanism 2 to be notes to be returned to the customer, and is transferred to the port mechanism 3 by the transferring section 42 so as to return the notes to the port 3*a*. Subsequently, the hand section 41 grasps the notes in the stack portion 25*b* which were determined by the counting mechanism 2 to be notes to be accepted, and is transferred to the accommodating mechanism 1 by the transferring section 42 so as to deliver the notes to the cashbox 1*b* of the accommodating mechanism 1.

The hand section 41 may alternatively be in the form of a tray 41', as shown in FIG. 5(*c*).

The control section 5 controls the transferring device 4, accommodating mechanism 1, counting mechanism 2, and port mechanism 3 according to the programs set for each type of transaction. The control section 5 therefore is provided with a memory (not shown) for storing these operation sequences and a microcomputer for reading and performing the operation sequences. The control section 5 is disposed on the supporting table 6 at the rear of the accommodating mechanism 3.

In FIG. 2, reference numeral 7 designates a power source.

Thus, in a discharging transaction, the hand section 41 of the conveying device is adapted to grasp and take out en bloc in the accommodating mechanism 1 a suitable number of notes. More specifically, the hand section 41 is adapted to grasp en bloc in the accommodating mechanism 1 a number of notes which is slightly more than the maximum dischargeable number which a customer can draw out in one operation from the apparatus. The gap between the pair of fingers 413, 414 of the hand section 41 is therefore preset so that the fingers can grasp in the accommodating mechanism 1 a number of notes which is slightly more than the maximum dischargeable number.

The operation involving the discharging transaction conducted by this embodiment of the apparatus for automatically conducting cash handling transactions will be described hereinunder with reference to FIGS. 6 to 8.

Figure 6:
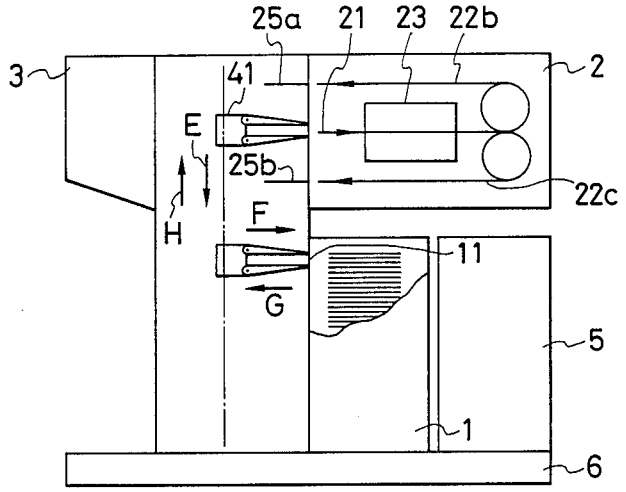
FIG. 6 shows in an explanatory way the operation of a hand which takes out sheets of paper from an accommodating section in a transaction involving the discharge of sheets of paper.

The hand section 41 of the conveying device 4 is at a position at the initial stage where it faces the receiving section 21 of the counting mechanism 2, as shown in FIG. 6.

When a customer operates a discharging transaction and specifies the amount of cash to be paid from the operating section, the hand section 41 moves downward to the position facing the port 11 of the cashbox 1*a* of the accommodating mechanism 1 immediately, as shown by the arrow E of FIG. 6, and then moves forward into the port 11, as shown by the arrow F of FIG. 6, such as to grasp and take out a suitable number of notes en bloc from the upper portion of the pile of notes in the cashbox 1*a*.

At this time, the hand section 41 grasps the notes in a number which is slightly larger than the maximum dischargeable number allowed in one transaction, i.e., in a number which is always larger than the number specified by the customer.

Figure 8:
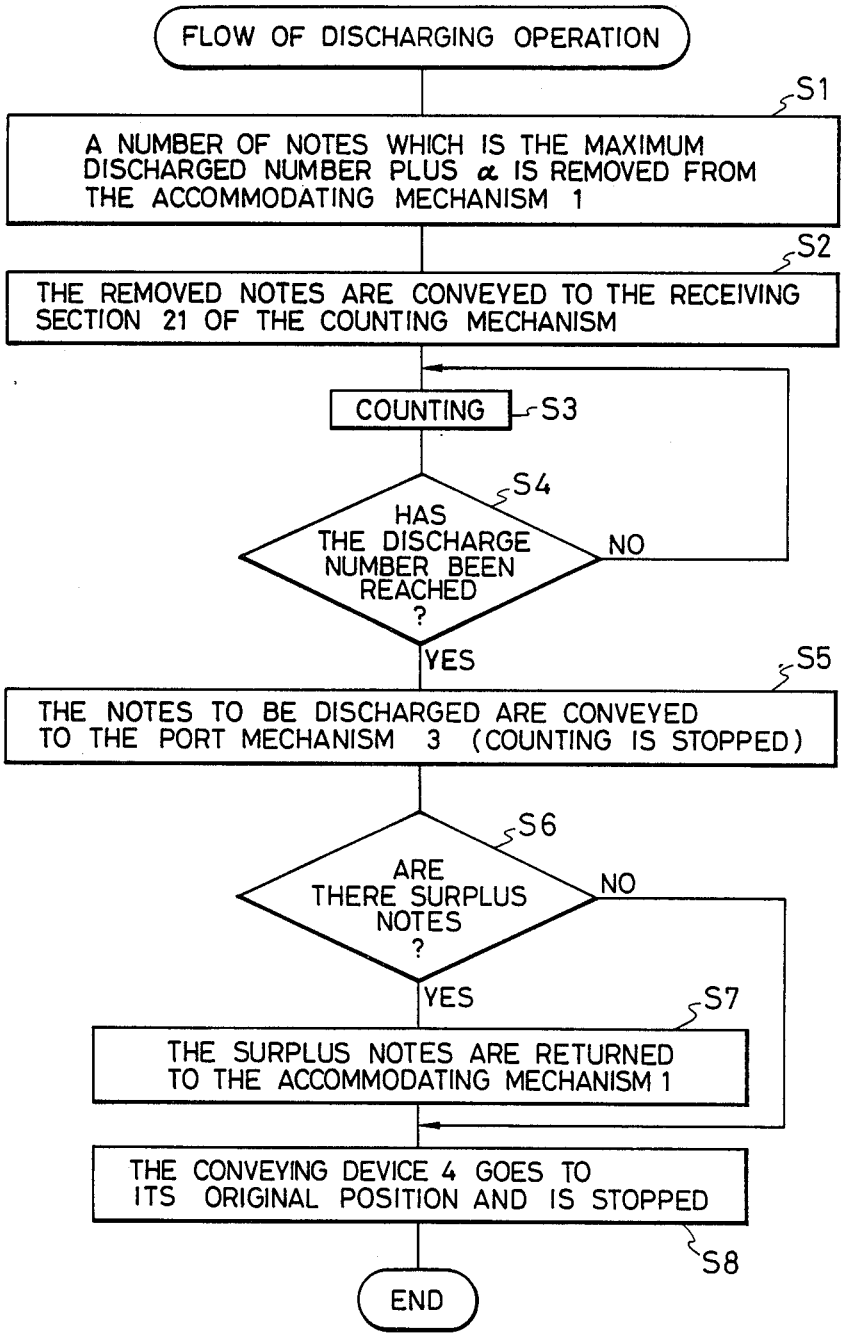
FIG. 8 is a flowchart of the operation performed for a transaction.

After grasping the notes en bloc in the manner described above, the hand section 41 retreats in the direction shown by the arrow G of FIG. 6 so as to take out the notes from the accommodating mechanism 1 (S1 of FIG. 8). The hand section 41 then moves upward in the direction shown by the arrow H, stops temporarily at a position where it faces the receiving section 21 of the counting mechanism 2, and moves forward such as to place the bundle of notes on the table 21*a* of the receiving section 21 (S2 of FIG. 8). The notes placed are accepted into the counting mechanism 2 by the rotation of the feed roller 21*b* (FIG. 3) of the receiving section 21, and are discriminated and counted by means of the discriminator 23, gate 24 and sensor 26*c* (S3). At this time, it is judged whether the number of notes has reached the number which is specified by the customer (S4). If not, the notes to be dealt with continue to be passed through the conveying passage 22*b* and piled on the stack portion 25*a* until the specified number is reached. When it is determined that the number has been reached, counting is stopped, and the notes exceeding the amount to be paid are conveyed to and piled on the stack section 25*b* as notes not to be dealt with.

Figure 7:
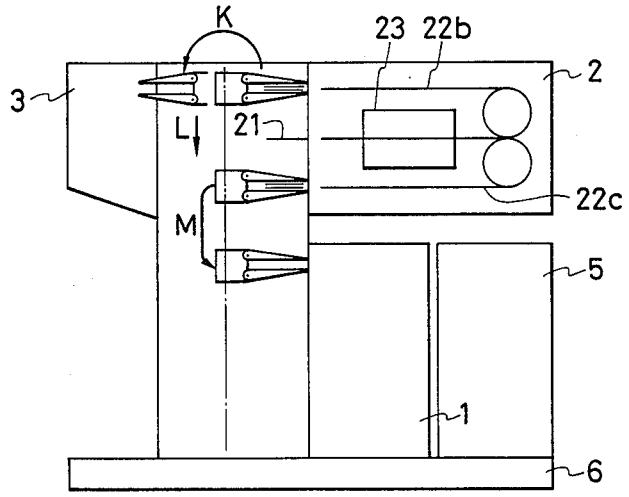
FIG. 7 shows in an explanatory way the operation of the hand which carries the sheets of paper to a port section in a transaction involving the discharge of sheets of paper.

The hand section 41 which has been positioned at the receiving section 21 then moves upward toward the stack section 25*a*, moves forward to the stack section 25*a* such as to grasp the notes piled on the stack section 25*a* (S5 of FIG. 8), and rotates by 180° in the direction shown by the arrow K of FIG. 7, so that it releases the notes at the port 3*a* of the port mechanism 3. The notes discharged in this manner can be pulled out by the customer.

Thereafter, the hand section 41 rotates in the direction opposite to that shown by the arrow K, moves downward in the direction shown by the arrow L to the stack section 25*b* such as to grasp the bundle of notes piled on the stack section 25*b*. The hand section 41 then moves further downward as shown by the arrow M, enters the port 11 of the cashbox 1*a*, and releases the held notes onto the pile of notes in the cashbox 1*a* (S7).

The hand section 41 of the conveying device 4 then returns to its initial position (original position) and stops (S8).

As will be clear from the foregoing description, in the apparatus of this embodiment, the port mechanism 3, counting mechanism 2 and accommodating mechanism 1 are formed as separate units and the notes are distributed among those components 1 to 3 by the conveying device 4. In consequence, the structure of the accommodating mechanism 1 can be made simpler and the number of parts thereof can be decreased, compared with the known apparatus in which the accommodating mechanism has note accepting and discharging functions. Moreover, since the respective components 1 to 4 are separately formed, the method of assembling these components can be improved.

In the conveying device 4, the notes are gripped and conveyed by the hand section 41, thus requiring no belts. Therefore, it is possible to eliminate the fluctuations of carrying speed which would occur in the prior art when the length of the belt was changed. This therefore enables an adequate control of the conveying device 4.

The notes in the accommodating mechanism 1 are grasped by the hand section 41 in a number which is more than the maximum dischargeable number. Therefore, only one operation is necessary. This also enables the conveying time of notes in the transaction to be remarkably reduced, allowing the speeding up of the payment to the customer.

Figure 9:
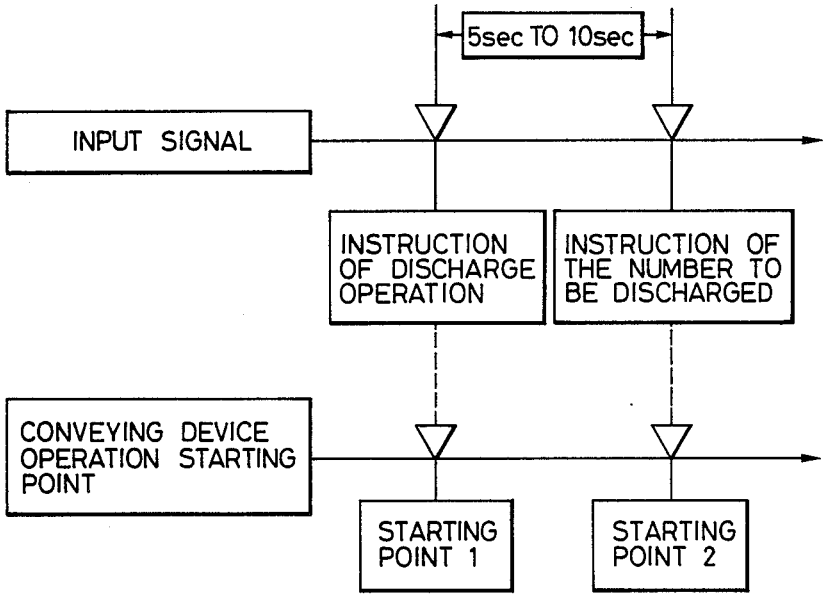
FIG. 9 shows in an explanatory way the situation when the operation of the conveying device is started.

The hand section 41 may be instructed to start moving towards the accommodating mechanism 1, as shown in FIG. 9, at the point when the customer specifies the paying transaction, although the starting time may be slightly changed depending on the carrying distance and moving speed (starting point 1). The hand section 41 may be instructed to have already begun taking out notes at the point when the amount to be paid is specified by the customer (starting point 2). This allows the discharging time to be further reduced.

Figure 10:
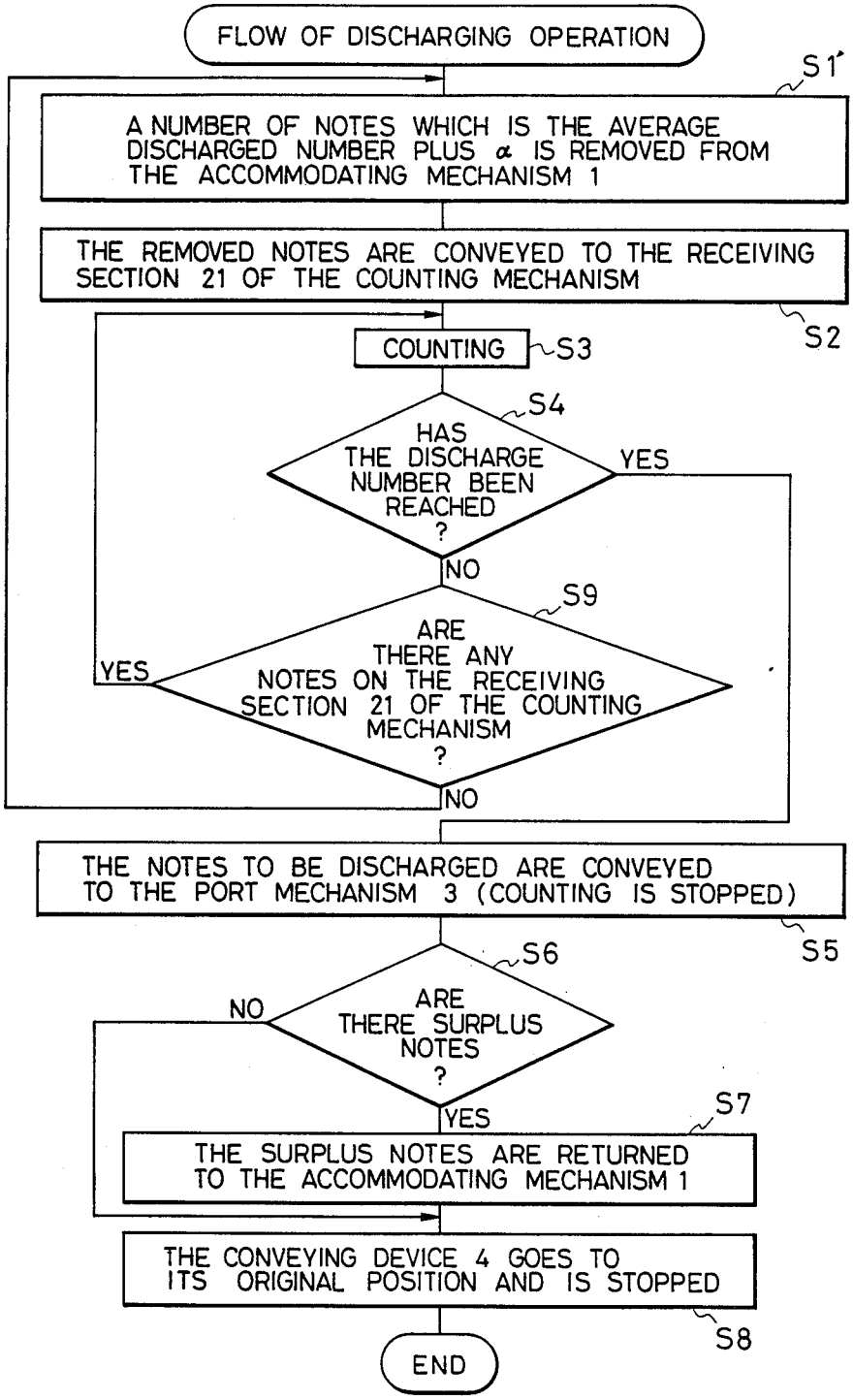
FIG. 10 is a flowchart of the operation of the apparatus, showing a second embodiment of the present invention.

FIG. 10 is a flowchart of the operation conducted by the apparatus of a second embodiment of the present invention. The apparatus of this embodiment is different from that of the first embodiment in that in a discharging transaction the notes in the accommodating mechanism 1 are taken out en bloc by the hand section 41 in a number which is more than the average discharged number. The average discharged number in this case means the average number of notes which are drawn out by the customers in a discharge transaction at the site where the apparatus is installed.

In consequence, the amount of money specified by the customer could exceed the average amount, i.e., the number of notes which are taken out en bloc by the hand section 41 from the accommodating mechanism 1. Therefore, as shown in FIG. 10, if it is judged in S4 that the number of notes which have been sorted to be dealt with by the counting mechanism 2 have not reached the amount specified by the custsomer, the processing goes to S9 in which it is determined if notes still remain in the receiving section 21 of the counting mechanism 2. If the answer is Yes, the processing returns to S3. If No, the processing goes back to S1.

In this embodiment, if the amount specified by the customer exceeds that of the average discharged number, another bundle of notes is taken out from the accommodating mechanism 1 by the hand section 41 of the conveying device 4. However, the number of notes taken by the hand section 41 is an average one, and in most of the transactions only one operation is necessary. Further, the number of notes taken out by the hand section 41 is smaller than that of the first embodiment but not too small, and this ensures that the hand section 41 grasps the notes accurately.

In this embodiment, like the first embodiment, since the operation of the hand section 41 (which removes the notes) can be commenced at starting point 1 of FIG. 9, the note discharging time can be reduced.

Figure 11:
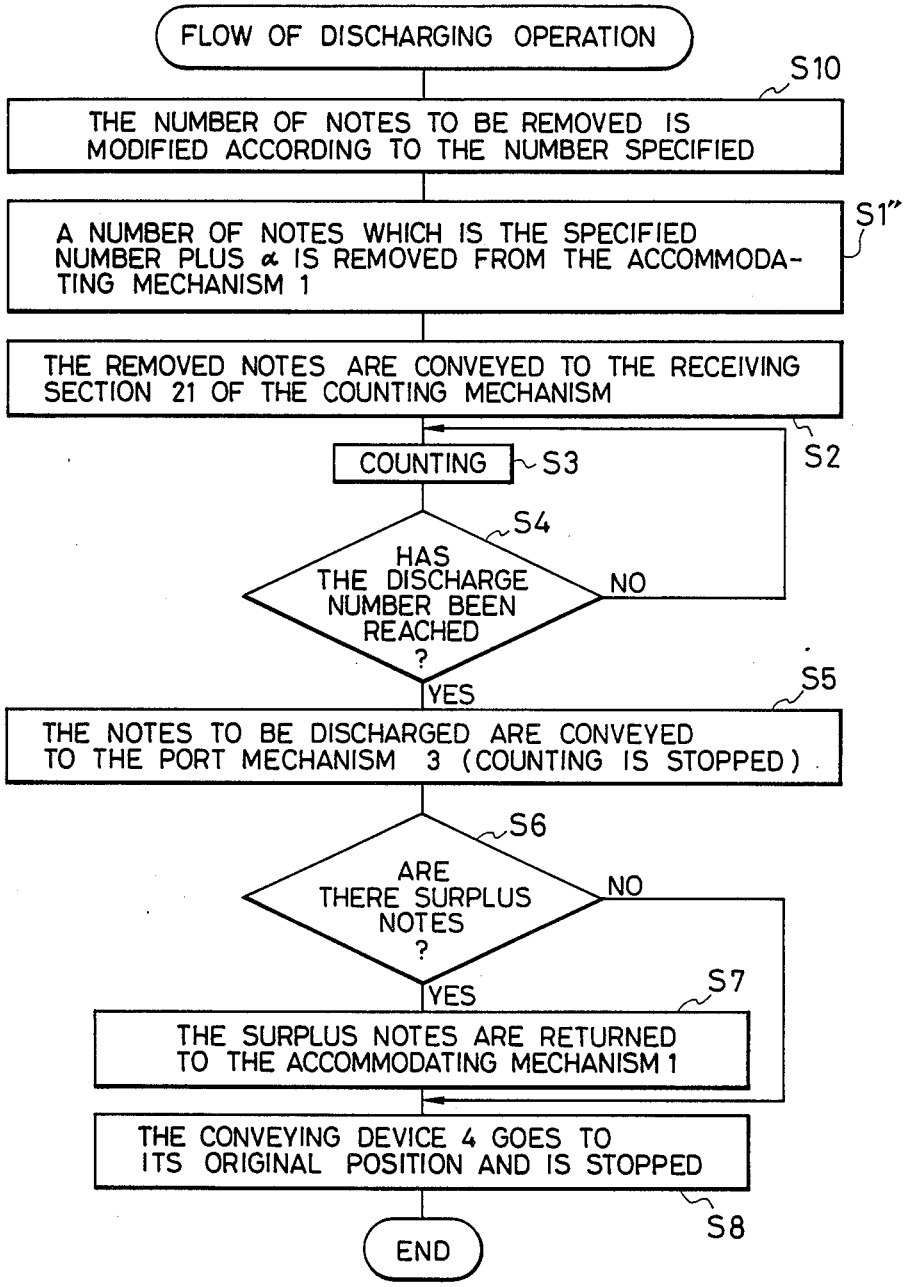
FIG. 11 is a flowchart of the operation of the apparatus, showing a third embodiment of the present invention.

FIG. 11 is a flowchart of the operation of the third embodiment of the present invention. The apparatus of this embodiment is different from the foregong two embodiments in that the notes are taken out from the accommodating mechanism 1 en bloc by the hand section 41 of the conveying device 4 in a number which is slightly larger than the one specified by the customer. In consequence, when the hand section 41 grasps the notes in the accommodating mechanism 1, the number of notes to be grasped is modified according to the amount to be paid (S10). The gap between the fingers 413, 414 of the hand section 41 is then adjusted accordingly.

Thus, in this embodiment, only one operation of the hand section 41 is necessary, when the hand section 41 takes out the notes from the accommodating mechanism 1. Further, the number of notes to be returned to the accommodating mechanism 1 can be reduced. Further, after the counting mechanism 2 has sorted notes to the number specified by the customer, the number of notes not to be dealt with which are carried to the stack section 25*b* can be reduced, thereby reducing the processing time thereof.

A fourth embodiment of the present invention will be described hereinunder with reference to FIGS. 12 to 14.

In each of the foregoing embodiments, when it is determined at S4 in the flowchart that the number to be discharged has been reached, counting is suspended at S5, while the notes exeeding the amount to be paid are conveyed to the stack section 25*b* as the notes not to be dealt with. In this embodiment, however, if the answer is Yes in S4, the counting and the conveyance are suspended at S5'. In consequence, the surplus notes, if any, remain in the receiving section 21 after the number to be discharged has been reached. These surplus notes in the receiving section 21 are then returned to the accommodating mechanism 1 in S6'.

The operation of the apparatus of this embodiment will be described below referring to FIGS. 13 and 14. Referring first to FIG. 13, when the specified number has been reached by the counting mechanism 2, the conveyance of the notes is stopped.

Figure 12:
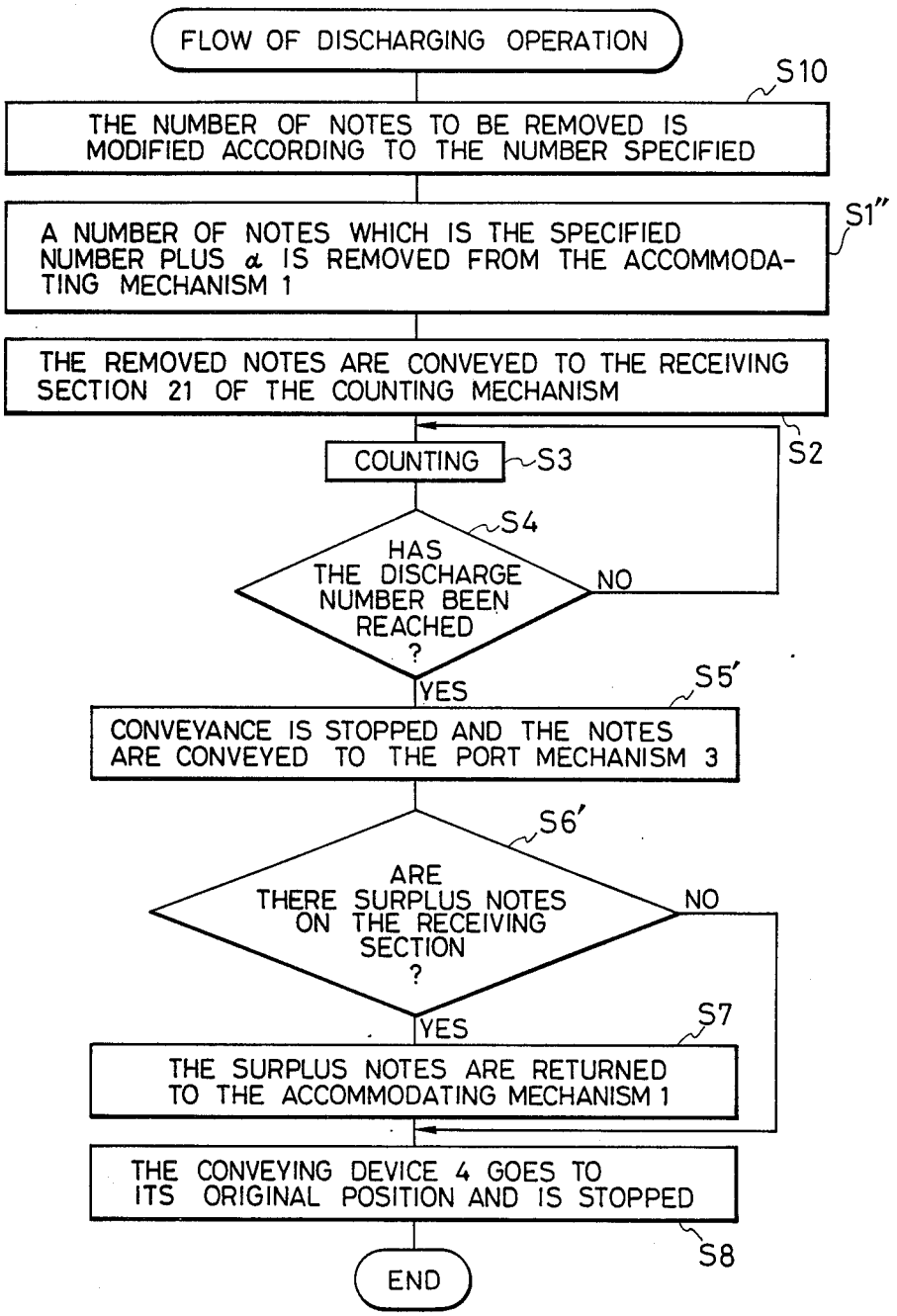
FIG. 12 is a flowchart of the operation of the apparatus, showing a fourth embodiment of the present invention.
Figure 13:
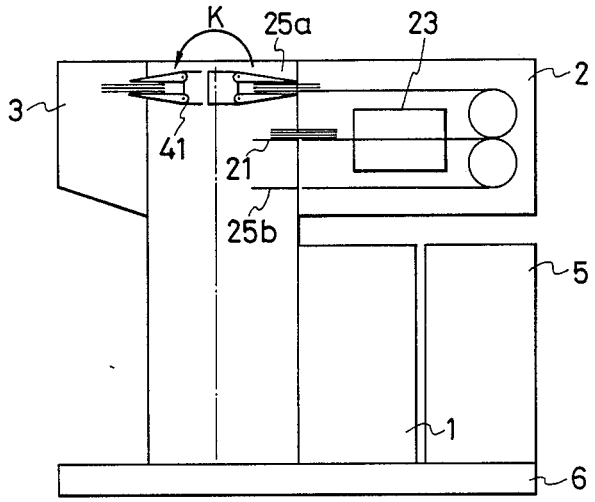
FIGS. 13 and 14 respectively show the processes of a paying operation performed by the apparatus shown in FIG. 12.

Thereafter, the hand section 41 moves upward from the receiving section 21 toward the stack section 25*a*, moves forward to the stack section 25*a*, and grasps the pile of notes on the stack section 25*a* (S5' of FIG. 12). The hand section 41 then rotates by 180° in the direction shown by the arrow K in FIG. 13, so that it delivers the notes to the port 3*a* of the port mechanism 3 and releases the notes.

Figure 14:
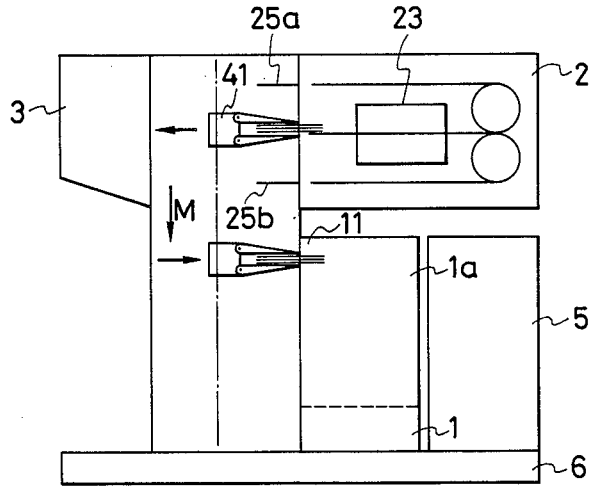

The hand section 41 then rotates in the direction opposite to that shown by the arrow K, moves downward as shown by the arrow L, and grasps the bundle of notes piled on the receiving section 21, as shown in FIG. 14. The hand section 41 then moves further downward as shown by the arrow M, enters the port 11 of the cashbox 1*a*, and releases the notes onto the pile of notes in the cashbox 1*a* (S7).

The hand section 41 of the conveying device 4 returns to its initial position (original position) and stops there (S8).

As will be understood from the foregoing description, when the specified number has been reached in this embodiment, conveyance of the notes exceeding the amount to be paid is suspended, i.e., it is not necessary to convey the surplus notes to the stack section 25*b*, as is the case in the foregoing embodiments. This enables the processing time to be reduced.

Figure 15:
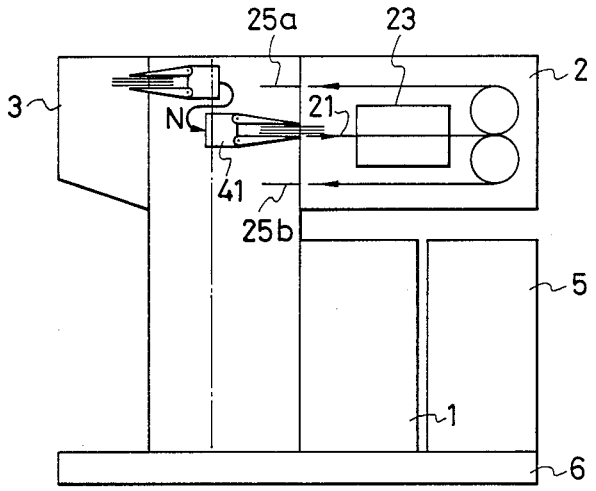
FIGS. 15 and 16 respectively show the processes of a deposit accepting operation conducted by the apparatus shown in FIG. 12.
Figure 16:
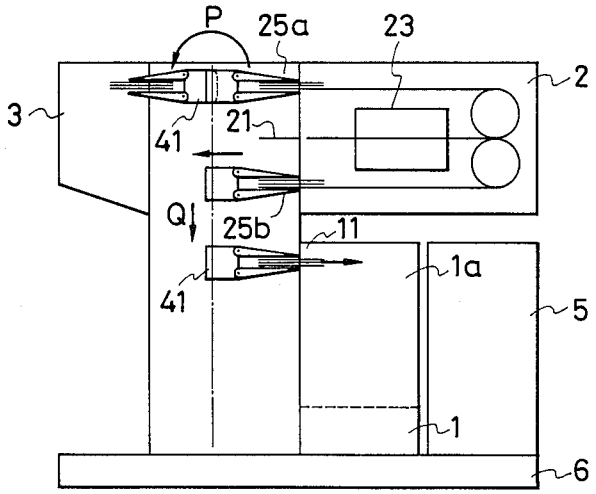
Figure 17:
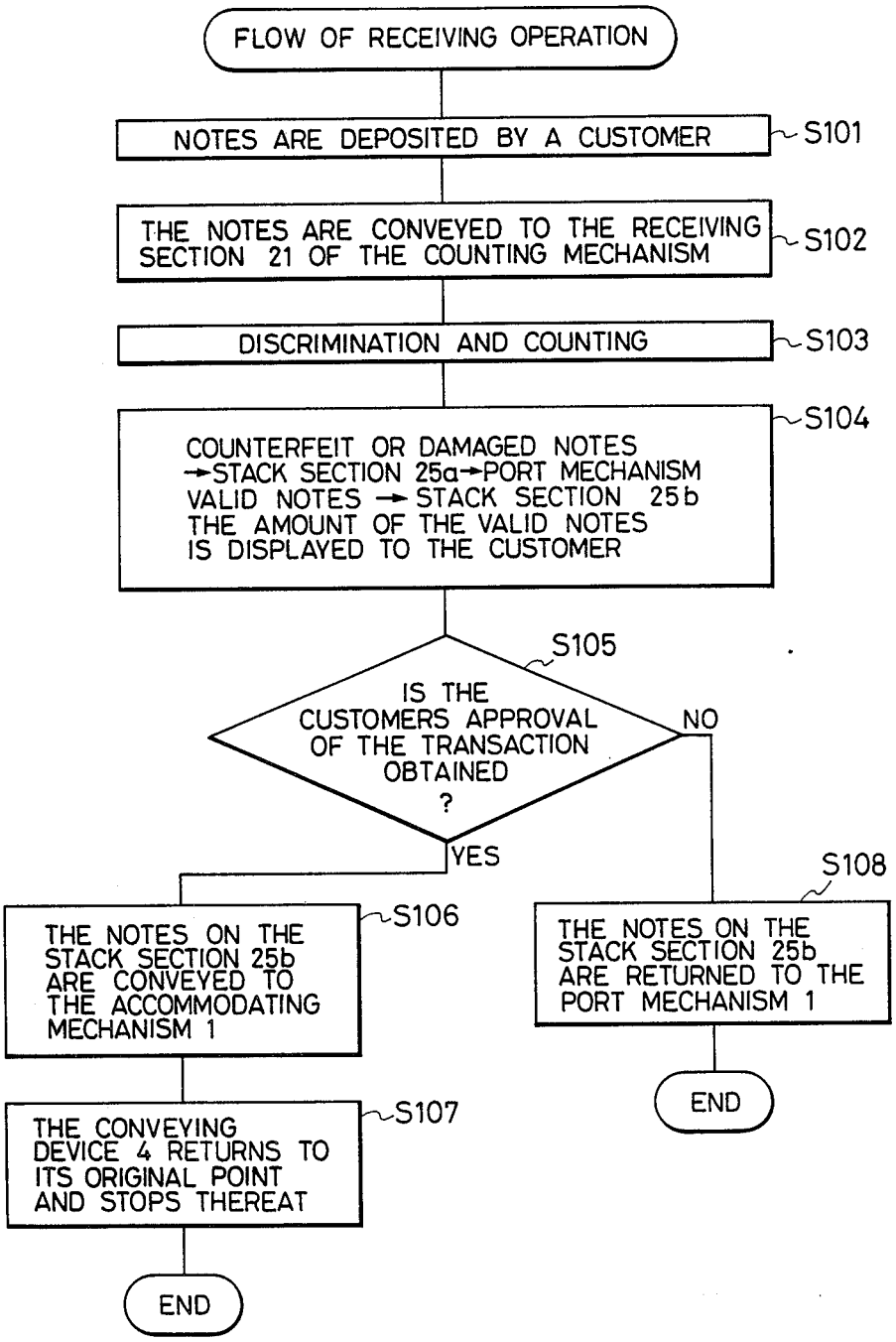
FIG. 17 is a flowchart of the operation of the apparatus shown in FIG. 12.

The operation of a deposit accepting transaction will be described below with reference to FIGS. 15 to 17. As in the paying transaction, the hand section 41 is at a position in its initial stage where it faces the receiving section 21 of the counting mechanism 2. When the customer specifies the depositing transaction as well as the amount to be deposited, the hand section 41 moves to and waits at the port mechanism 3, as shown in FIG. 15. The hand section 41 then grasps the bundle of notes deposited in this portion, turns over, as shown by the arrow N, moves downward, and delivers the notes to the receiving section 21 of the counting mechanism 2 (S102).

The notes which have been carried to the counting mechanism 2 are accepted one by one as the feed roller 21*b* rotates so that they are sorted and counted (S103). The notes are then conveyed selectively to the stack sections 25*a* and 25*b*. Assume that valid notes are conveyed to the stack section 25*b*, while the counterfeit or damaged notes are sent to the stack section 25*a*. The hand section 41 grasps the bundle of notes on the stack section 25*a* and returns them to the port mechanism 3, as shown by the arrow P of FIG. 16 (S104). At this point, the amount of the valid notes is displayed to the customer, and the customer's approval of the displayed amount is requested. The notes returned in the above-described manner may be redeposited at port mechanism 3 for a second trial. If the returned notes are not redeposited, the customer instructs from the operating section whether he approves the transaction with the amount displayed or cancels it.

If the transaction is approved, i.e., if the answer is Yes in S105, S106 is then executed in which the hand section 41 grasps en bloc the valid notes at the stack section 25*b*, moves backward, moves downward in the direction shown by the arrow Q, moves forward to the accommodating mechanism 1, enters the port 11 of the cashbox 1*a*, and releases the notes onto the pile of notes in the cashbox.

The hand section 41 then returns to its initial position (original position) and stops thereat (S107).

If the transaction is cancelled by the customer in S105, i.e., if the answer at S105 is No, then S108 is executed in which the valid notes at the stack section 25*b* are returned to the port mechanism 3, and the transaction is thereby ended.

Figure 20:
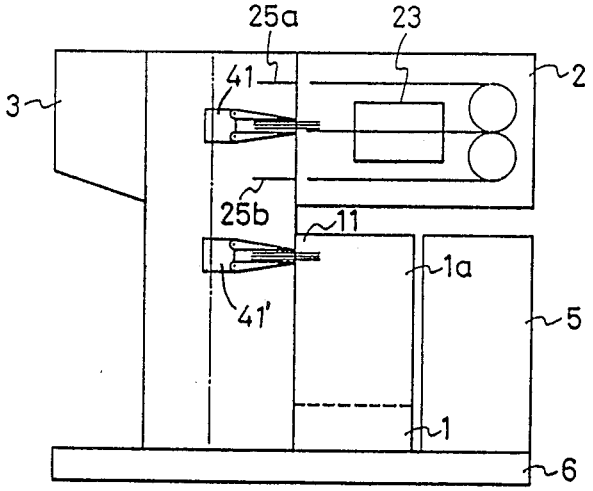
FIG. 20 shows an apparatus for handling sheets of paper according to another embodiment of the present invention that includes two hand sections.

The above-described embodiment uses only one hand section 41. However, according to another embodiment of the present invention, two or more hand sections may be employed. FIG. 20 shows an embodiment wherein two hand sections 41 and 41' are used. One hand section, 41 for example, may be adapted to take care of the conveyance of notes between the port mechanism 3 and the counting mechanism 2, while the other hand section 41' may be adapted to carry notes between the counting mechanism 2 and the accommodating mechanism 1. In this way the processing time can be further reduced.

Figure 18:
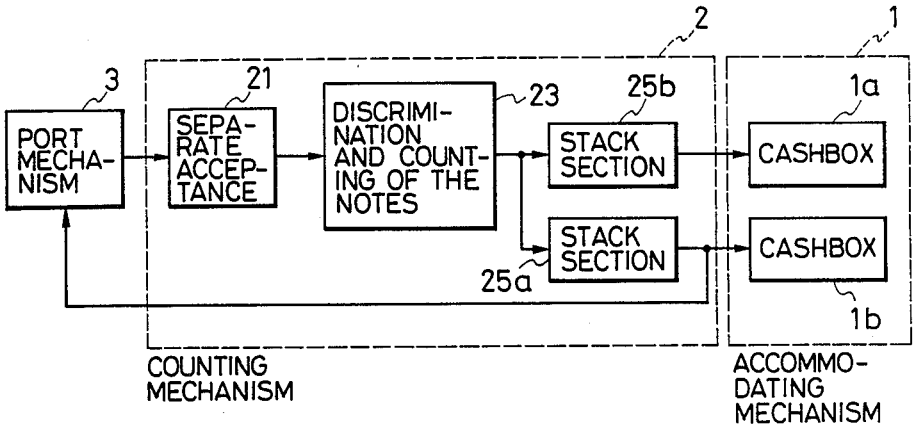
FIG. 18 shows how a note dispensing apparatus constructed in accordance with the present invention functions when it receives the money.
Figure 19:
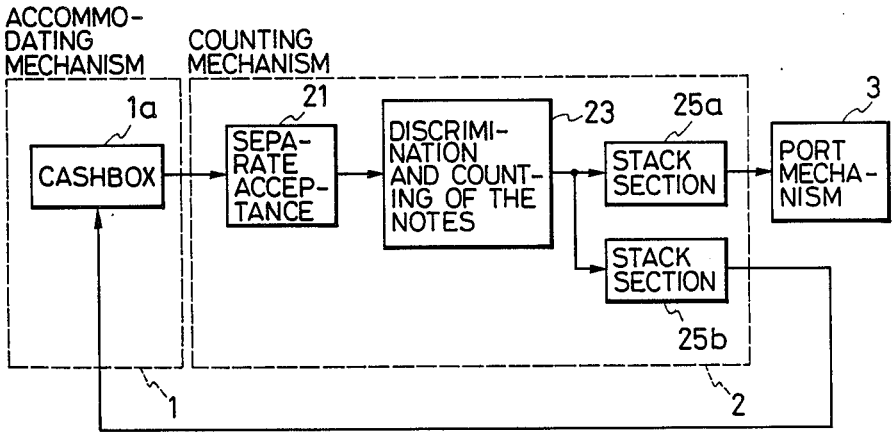
FIG. 19 shows how the note dispensing apparatus constructed in accordance with the present invention functions when it pays out money.

FIG. 18 shows the operational sequences of a deposit accepting transaction, while FIG. 19 shows those of a paying transaction. As seen from these diagrams, the cashbox 1, counting section 2, conveying section 4 and port section 3 are used in both types of transactions, thereby enabling the entire construction to be simpler and the production cost to be lower.

What is claimed is:

1. An apparatus for handling sheets of paper, comprising:

a single port providing a first terminus permitting customers during a deposit transaction to put sheets of paper into and during a dispensing transaction to remove sheets of paper from said apparatus;

accommodating means including a second terminus, for accommodating storage of sheets of paper between transactions and for accommodating passage of sheets of paper at said second terminus during said transactions;

single counting means accessible to sheets of paper from both said port and said accommodating means and providing a third terminus receiving and storing sheets of paper and other termini storing sheets of paper, for counting, discriminating between sheets of paper and dividing said sheets of paper among said other termini on the basis of said discriminating into sheets of paper to be dealt with and sheets of paper not to be dealt with, during both deposit and dispensing transactions; and conveying means for distributing sheets of paper en bloc among said port, accommodating means and counting means during both deposit and dispensing transactions, said second, third and other termini being arranged in a vertical row along a path of travel by said conveying means to enable said conveying means to obtain sheets of paper at said termini and to distribute sheets of paper en bloc among said accommodating means and counting means as said conveying means travels along the path;

wherein said conveying means moves sheets of paper between said port and said accommodating means via said counting means and between said accommodating means and said port via said counting means according to the type of transaction.

2. An apparatus for handling sheets of paper according to claim 1, wherein said conveying means includes:

a hand section for retaining en bloc said sheets of paper and for delivering sheets of paper among said port, counting means and accommodating means via said first, second, third and other termini; and a transferring section for transferring said hand section to any of said port, counting means and accommodating means.

3. An apparatus for handling sheets of paper according to claim 2, wherein in a dispensing transaction said hand section is adapted to take out en bloc from said accommodating means a number of sheets of paper which is larger than a maximum number of sheets of paper previously discharged in a single dispensing transaction.

4. An apparatus for handling sheets of paper according to claim 2, wherein in a dispensing transaction said hand section is adapted to take out en bloc from said accommodating means a number of sheets of paper which is larger than an average of a number of sheets of paper discharged during previous dispensing transactions.

5. An apparatus for handling sheets of paper according to claim 2, wherein in a dispensing transaction said hand section is adapted to take out en bloc from said accommodating means a number of sheets of paper which is larger than a number specified by a customer

6. An apparatus for handling sheets of paper according to claim 1, wherein said counting means includes:

a receiving section including said third terminus, for accepting the sheets of paper delivered by said conveying means;

a conveying passage through which the sheets of paper accepted by said receiving section are conveyed one by one;

a counting section for discriminating the sheets of paper conveyed through said conveying passage into those to be dealt with and those not to be dealt with and for counting said sheets of paper to be dealt with; and a plurality of stack sections including said other termini, for temporarily retaining separately said sheets of paper to be dealt with and not to be dealt with such that each type of said sheets of paper is separately taken en bloc from said stack sections and delivered by said conveying means.

7. An apparatus for handling sheets of paper according to claim 1, wherein said port, said counting means, said accommodating means and said conveying means are separately formed, and said sheets of paper are distributed through the intermediary of said conveying means among said port, counting means and accommodating means.

8. An apparatus for handling sheets of paper, comprising:

an accommodating section for accommodating sheets of paper between deposit and discharging transactions;

a counting section for discriminating and counting said sheets of paper and for dividing said sheets of paper between those to be dealt with and those not to be dealt with during both deposit and discharging transactions;

a single orifice forming a port section through which said sheets of paper are put in and taken out of said apparatus during respective ones of deposit and discharging transactions;

a conveying section for taking out said sheets of paper from said accommodating section and delivering the same to said counting section in a discharging transaction, as well as for taking out said sheets of paper from said port section and delivering the same to said counting section in a deposit transaction, for during a deposit transaction, transporting en bloc said sheets of paper not to be dealt with from said counting section to said orifice and separately transporting en bloc said sheets of paper to be dealt with from said counting section to one of said accommodating section and said orifice, and for during a discharging transaction, transporting en bloc said sheets of paper to be dealt with from said counting section to said orifice and separately transporting en bloc said sheets of paper not to be dealt with from said counting section to said accommodating section during a discharging transaction;

a control section for controlling said counting section, and said conveying section according to a predetermined program;

wherein said conveying section includes a hand portion for grasping and releasing en bloc said sheets of paper at predetermined positions relative to said sections, and a transferring portion for transferring said hand portion to the predetermined positions, said hand portion taking out en bloc in the discharging transaction a suitable number of said sheets of paper from said accommodating section.

9. An apparatus for handling sheets of paper according to claim 8, wherein in a discharging transaction said hand portion is adapted to take out said sheets of paper from said accommodating section in a number which is larger than a maximum discharged number of sheets of paper previously discharged in a single discharging transaction.

10. An apparatus for handling sheets of paper according to claim 8, wherein in a discharging transaction said hand portion is adapted to take out en bloc said sheets of paper from said accommodating section in a number which is larger than an overage of a number of sheets of paper discharged in previous discharging transactions.

11. An apparatus for handling sheets of paper according to claim 8, wherein in a discharging transaction said hand portion is adapted to take out en bloc said sheets of paper from said accommodating section in a number which is larger than a number specified by a customer.

12. An apparatus for handling sheets of paper according to claim 8, wherein said counting section includes:

a receiving portion for accepting the sheets of paper delivered by said conveying section;

a main conveying passage through which the sheets of paper accepted by said receiving portion are conveyed one by one;

a counting portion for discriminating between the sheets of paper conveyed through said main conveying passage into those to be dealt with and those not to be dealt with and for counting the sheets of paper to be dealt with; and a plurality of stack portions for temporarily retaining said sheets of paper to be dealt with and not to be dealt with separately such that each type of said sheets of paper is delivered by said conveying section.

13. An apparatus for handling sheets of paper, comprising:

at least one accommodating section for accommodating sheets of paper;

a counting section for discriminating between and counting said sheets of paper and separating said sheets of paper into those to be dealt with and those not to be dealt with;

a port section through which said sheets of paper are put in and taken out of said apparatus;

a conveying section for taking out said sheets of paper from said accommodating section and delivering the same to said counting section in a discharging transaction, as well as for taking out said sheets of paper from said port section and delivering the same to said counting section in a deposit accepting transaction; and a control section for controlling said counting section and said conveying section according to a preset program;

wherein said counting section includes:

a receiving portion for accepting the sheets of paper delivered by said conveying section;

a main conveying passage through which said sheets of paper received by said receiving portion are conveyed one by one;

a discriminator for discriminating between the sheets of paper conveyed through said main conveying passage and for separating the sheets of paper conveyed on the basis of the discriminating into those to be dealt with and those not to be dealt with, and for counting said sheets of paper to be dealt with; and a plurality of stack portions for temporarily and separately retaining said sheets of paper to be dealt with and not to be dealt with such that said sheets of paper to be dealt with and said sheets of paper not to be dealt with may be separately taken en bloc from said counting section by said conveying section.

14. An apparatus for handling sheets of paper according to claim 13, wherein in a discharging transaction:

said counting section is adapted to separate the number of paper sheets which is specified by a customer from sheets of paper delivered to said receiving portion from said accommodating section, retain said specified number of paper sheets on said stack portion for retaining sheets of paper to be dealt with, and retain surplus sheets of paper on said stack portion for retaining sheets of paper not to be dealt with, and said conveying section is adapted to take out sheets of paper to be discharged from said stack portion for retaining the notes to be dealt with and deliver the same to said port section and to take out said surplus sheets of paper from said stack portion for retaining the notes not to be dealt with and deliver the same to said accommodating section.

15. An apparatus for handling sheets of paper according to claim 13, wherein in a discharging transaction:

said counting section is adapted to sort the number of paper sheets which is specified by a customer out of sheets of paper delivered to said receiving portion from said accommodating section and to temporarily retain the same on said stack portion for retaining the notes to be dealt with, and to temporarily retain surplus sheets of paper on said receiving portion, and said conveying section is adapted to take out sheets of paper to be discharged from said stack portion for retaining sheets of paper to be dealt with and deliver the same to port section and to take out said surplus sheets of paper from said receiving portion and deliver the same to said accommodating section.

16. An apparatus for handling sheets of paper according to claim 13, wherein:

in a note depositing transaction said counting section is adapted to separated sheets of paper delivered to said receiving portion from said port section into valid sheets of paper and counterfeit or damaged sheets of paper, to retain said valid sheets of paper on said stack portion for retaining sheets of paper to be dealt with, and to retain said counterfeit or damaged sheets of paper on said stack portion for retaining sheets of paper not to be dealt with, and said conveying section is adapted to take out the sheets of paper from said stack portion for retaining the sheets of paper not to be dealt with and returning the same to said port section and to take out the sheets of paper from said stack portion for retaining the sheets of paper to be dealt with and conveying the same to said accommodating section.

17. An apparatus for handling sheets of paper according to claim 13, wherein said accommodating section, said counting section, said port section and said conveying section are separately formed, and said paper sheets are delivered to each of said sections through the intermediary of said conveying section.

18. An apparatus for handling sheets of paper, comprising:

port means providing a first terminus permitting customers during a deposit transaction to put sheets of paper into and during a dispensing transaction to remove sheets of paper from said apparatus;

accommodating means including a second terminus, for accommodating storage of sheets of paper between transaction and for accommodating passage of sheets of paper at said second terminus during said transactions;

counting means accessible to sheets of paper from both said port means and said accommodating means, said counting means including:

a receiving portion for accepting and temporarily storing both single sheets of paper and a plurality of sheets of paper from said port means and said accommodating means;

a counting portion for counting one by one sheets of paper from said receiving portion; and a stacking portion for temporarily stacking counted sheets of paper conveyed from said counting portion;

said counting portion being disposed along a path of travel of said sheets of paper between said receiving portion and said stacking portion, with the sheets of paper traversing said counting portion while traveling between said receiving portion and said stacking portion; and transporting means for distributing sheets of paper en bloc among said first and second termini, and said receiving portion and stacking portion.

19. An apparatus for handling sheets of paper, comprising:

articulated manipulator means including a body, a pair of fingers disposed on said body for opening and closing relative to a first axis, and a first motor disposed on said body for operating said pair of fingers to open and to close, for grasping and releasing a bundle of sheets of paper; and a transfer assembly including:

a table supporting and enabling said body to slide along a second axis and to rotate about a third axis, a vertical operating mechanism moving said table vertically along a fourth axis transverse to said second axis, a second motor for sliding said body along the second axis, a third motor for rotating said body about the third axis, and a fourth motor for moving said table vertically along the fourth axis.

20. An apparatus according to claim 19, wherein said table comprises a supporting plate disposed relative to said vertical operating mechanism to be moved vertically in said fourth direction, a sliding table disposed rotatably relative to said supporting plate for slidably holding said body of the manipulator means, whereby said manipulator means advances forwardly and retreats along said second axis to grasp, transport and release a bundle of sheets of paper, and rotates about said third axis to transport a bundle of sheets of paper.

21. An apparatus for handling sheets of paper, comprising:

a single port through which sheets of paper are put into and taken out of said apparatus;

accommodating means for accommodating the sheets of paper put into and to be taken out of said apparatus;

single counting means common to both said port and accommodating means and including a receiving portion temporarily storing stacks of sheets of paper prior to counting and plurality of stack portions each temporarily storing different stacks of sheets of paper after counting, for counting the sheets of paper put into and to be taken out of said apparatus and for separating said sheets of paper between said plurality of stack portions;

transporting means for transporting the sheets of paper en bloc among said port, said accommodating means, said receiving portion and said plurality of stack portions; and a control means for controlling the operation of said counting means and said transporting means;

wherein the movement of said transporting means is controllable by said control means to transport the sheets of paper put into and to be taken out of said apparatus, among said port and said accommodating means via said counting means.

22. An apparatus according to claim 21, wherein said transporting means is controlled to transport the sheets of paper from both said port and said accommodating means to said counting means.

23. An apparatus according to claim 21, wherein said control means controls said transporting means to transport counted sheets of paper from said counting means to any one of said port means and said accommodating means.

24. An apparatus according to claim 21, wherein said control means controls said transporting means to transport the sheets of paper from one of said port means and accommodating means to said counting means to count the sheets of paper, and transports counted sheets of paper from said counting means to any one of said port means and said accommodating means.

25. An apparatus according to claim 21, wherein said control means controls said transporting means to hand the sheets of paper to said counting means, to receive counted sheets of paper from said counting means, and to transport the counted sheets of paper to any of said port means and said accommodating means.

26. An apparatus according to claim 21, wherein said control means controls said transporting means to receive the sheets of paper from any one of said port means and said accommodating means and to hand sheets of paper counted in said counting means to one of said port means and said accommodating means.

27. An apparatus according to claim 21, wherein said counting means comprises a counting portion for counting the sheets of paper one-by-one, said receiving portion accepts the sheets of paper transported by said transporting means, and said stack portion temporarily stacks counted sheets of paper conveyed from said counting portion whereby said counted sheets of paper may be grasped en bloc by said transporting means at one of said stack portions and handed by said transporting means to any one of said port means and accommodating means.

28. An apparatus according to claim 27, wherein said counting means includes a belt conveyor for conveying from said receiving portion the sheets of paper to be counted by said counting portion one by one.

29. An apparatus according to claim 21, wherein said accommodating means has a common port for receiving and dispensing the sheets of paper, and said counting means has a plurality of different ports provided by said receiving portion and plurality of stacking portions for respectively receiving and for dispensing the sheets of paper.

30. An apparatus for handling sheets of paper, comprising:

port means providing a single orifice through which the sheets of paper are put in and taken out of said apparatus;

accommodating means for accommodating the sheets of paper both put in and taken out of said apparatus;

single counting means common to both said port means and said accommodating means, said counting means including a plurality of spaced apart, separate locations for storing sheets of paper, for counting, discriminating between, sorting into stacks on the basis of said discriminating, and storing said stacks at said separate locations, the sheets of paper put in and to be taken out of the apparatus via said orifice;

transporting means for transporting the sheets of paper en bloc among said orifice, said accommodating means, said counting means and said plurality of locations; and control means for controlling the operation of said counting means and said transporting means;

wherein movement of said transporting means is controllable by said control means to transport to said accommodating means via said counting means the sheets of paper put into the port means, and to transport to said port means via said counting means sheets of paper stored in said accommodating means including sheets of paper transported to said accommodating means by said transporting means, whereby the sheets of paper received by said apparatus from one customer during one transaction may be dispensed by the apparatus to another customer during a subsequent transaction.

31. An apparatus according to claim 30, wherein said counting means includes means for discriminating between the sheets of paper transported by said transporting means and for sorting the sheets of paper into valid sheets of paper and invalid sheets of paper.

32. An apparatus according to claim 31, wherein said transporting means is controlled to transport the valid sheets of paper from one of said separate locations to said accommodating means whereby the valid sheets of paper are retained for dispensing.

33. An apparatus according to claim 32, wherein said transporting means is controlled to transport the valid sheets of paper from said accommodating means to said counting means and then to said port means to thereby dispense the valid sheets of paper from said apparatus via said port means.

34. An apparatus according to claim 32, wherein said counting means comprises a counter portion to discriminate the sheets of paper into valid sheets of paper and invalid sheets of paper, a first stack portion for temporarily stacking the valid sheets of paper, and a second stack portion for temporarily stacking the invalid sheets of paper, said transporting means being controlled by said controlling means to transport the valid sheets of paper from said first stack portion to said accommodating means.

35. An apparatus according to claim 31, wherein said transporting means is controlled to transport sheets of paper put into the apparatus through said port means to said counting means for discrimination between valid sheets of paper and invalid sheets of paper.

36. An apparatus according to claim 31, wherein said transporting means is controlled to transport sheets of paper from said port means to said counting means for discrimination between sheets of paper, and to transport valid sheets of paper from one of said separate locations to said accommodating means.

37. An apparatus according to claim 36, wherein said transporting means is controlled by said controlling means to transport the valid sheets of paper from said accommodating means to said counting means and then to said port means to dispense the valid sheets of paper from the apparatus.

38. An apparatus according to claim 31, wherein said counting means comprises a counter portion to discriminate between valid sheets of paper and invalid sheets of paper, a first stack portion at a first one of said separate locations for temporarily stacking the valid sheets of paper, and a second stack portion at a second one of said separate locations for temporarily stacking the invalid sheets of paper, said transporting means being controlled by said control means to transport the valid sheets of paper from said first stack portion to said accommodating means.

39. An apparatus for handling sheets of paper, comprising:

port means through which the sheets of paper are put into and taken out of the apparatus;

accommodating means for accommodating sheets of paper both put into and to be taken out of said apparatus;

single common counting means including a plurality of spaced apart, separate location for storing sheets of paper, for counting and sorting each sheet of paper put into and to be taken out of the apparatus, and for storing at said separate locations a plurality of different types of sheets of paper sorted by the counting means;

transporting means for transporting a plurality of sheets of paper between said counting means, and any one of said port means and said accommodating means; and control means for controlling the operation of said counting means and said transporting means, wherein said transporting means is controlled by said control means to transport the sheets of paper put into and to be taken out of said apparatus, between said port means and said accommodating means through said counting means.

40. An apparatus for handling sheets of paper according to claim 39, wherein said counting means comprises a conveying passage for conveying each sheet of paper to be counted, and said transporting means comprises a robot hand for transporting a plurality of sheets of paper.

41. An apparatus according to claim 40, wherein said transporting means comprises:

a hand section for grasping and releasing a plurality of sheets of paper at any one of said port means, said accommodating means, and said separate locations; and a transporting section for transporting said hand section among said port means, accommodating means and said counting means.

42. An apparatus according to claim 39, wherein said transporting means comprises:

a first robot hand traveling along a first axis between said port means and said counting means and traveling along a second axis obliquely transversing said first axis to grasp and retain the sheets of paper at said counting means, said separate locations and said accommodating means; and a second robot hand traveling along said first axis between said counting means and said accommodating means and traveling along said second axis to grasp and retain the sheets of paper at said counting means, said separate locations and said accommodating means.

43. An apparatus according to claim 39, wherein said counting means comprises a counting section for discriminating between sheets of paper to be dealt with and sheets of paper not to be dealt with.

44. An apparatus according to claim 39, wherein said counting means comprises:

a receiving section for accepting a plurality of the sheets of paper delivered by said transporting means; a belt conveyor through which the sheets of paper accepted by said receiving section are conveyed;

discriminating means for providing a basis for sorting the sheets of paper conveyed through said belt conveyor; and a stack section including said separate locations, for temporarily stacking the counted sheets of paper conveyed through said belt conveyor in stacks at said separate locations;

whereby said transporting means separately transports a plurality of sheets of paper from different ones of the separate locations in said stack portions to corresponding ones of said port means and said accommodating means.

45. An apparatus for handling sheets of paper, comprising:

port means providing a single orifice through which the sheets of paper are put into and taken out of said apparatus respectively in deposit and dispensing transactions;

accommodating means for accommodating between the transactions a pile of the sheets of paper both put into and to be taken out of said apparatus;

single common counting means for counting during deposit and dispensing transactions, the sheets of paper put into and to be taken out of the apparatus;

said counting means including means for discriminating between said sheets of paper and for sorting said sheets of paper into separate stacks on the basis of said discriminating;

transporting means for transporting en bloc a plurality of the sheets of paper among said port means, said accommodating means and said counting means; and control means for controlling the operation of said counting means and said transporting means;

wherein the movement of said transporting means is controllable by said control means to transport to said accommodating means the sheets of paper put into said port means via said counting means so as to put the sheets onto the pile in said accommodating means in a deposit transaction, and to transport to said port means via said counting means sheets of paper taken out from an upper portion of the pile in said accommodating means in a dispensing transaction.

46. An apparatus according to claim 45, wherein said counting means is adapted to sort the sheets of paper transported by said transporting means into a stack of valid sheets of paper and a stack of invalid sheets of paper.

47. An apparatus according to claim 46, wherein said transporting means is controlled to transport en bloc stack of valid sheets of paper from said counting means to said accommodating means whereby the valid sheets of paper are retained within the apparatus for dispensing through said port means via said counting means during a subsequent transaction.

48. An apparatus according to claim 47, wherein said transporting means is controlled to transport en bloc a stack of the valid sheets of paper from said accommodating means to said counting means and then to said port means to thereby dispense the valid sheets of paper from said apparatus.

49. An apparatus according to claim 46, wherein said transporting means is controlled to transport en bloc a stack of undiscriminated sheets of paper put into the apparatus through said port means to said counting means for discrimination between valid sheets of paper and invalid sheets of paper.

50. An apparatus according to claim 46, wherein said transporting means is controlled to transport en bloc a plurality of sheets of paper from said port means to said counting means for discrimination between the sheets of paper, and transports en bloc the stack of the valid sheets of paper from said counting means to said accommodating means.

51. An apparatus according to claim 46, wherein said counting means comprises a counter portion to discriminate between valid sheets of paper and invalid sheets of paper, a first stack portion for temporarily stacking the valid sheets of paper, and a second stack portion for temporarily stacking the invalid sheets of paper, said transporting means being controlled to transport en bloc the valid sheets of paper from said first stack portion to said accommodating means.

52. An apparatus for handling sheets of paper, comprising:

port means providing a single orifice through which the sheets of paper are put into and taken out of said apparatus;

accommodating means for accommodating a pile of the sheets of paper both put into and to be taken out of said apparatus;

counting means for receiving, counting, making discriminations between and sorting into separate stacks on the basis of the discriminations, the sheets of paper put into and to be taken out of the apparatus;

transporting means including a hand to grasp and release a plurality of sheets of paper, for transporting en bloc a plurality of sheets of paper grasped by the hand, between said port means, said accommodating means and said counting means; and control means for controlling the operation of said counting means and said transporting means;

wherein the movement of said transporting means is controllable by said control means to transport to said accommodating means via said counting means a plurality of the sheets of paper put into the apparatus through the orifice so as to release the plurality of sheets of paper onto the pile in said accommodating means, and to transport to said port means via said counting means a plurality of the sheets of paper grasped from an upper portion of the pile in said accommodating means.

53. An apparatus according to claim 52, wherein said counting means is adapted to discriminate between the sheets of paper transported by said transporting means and to divide the sheets of paper into valid sheets of paper and invalid sheets of paper.

54. An apparatus according to claim 53 wherein said transporting means is controlled to transport the valid sheets of paper from said counting means to said accommodating means whereby the valid sheets of paper are retained for dispensing by the apparatus during a subsequent transaction.

55. An apparatus according to claim 54, wherein said transporting means is controlled to transport the valid sheets of paper from said accommodating means to said counting means and then to said port means to thereby dispense the valid sheets of paper from said apparatus.

56. An apparatus according to claim 53, wherein said transporting means is controlled to transport sheets of paper in through said port means to said counting means for discrimination between valid sheets of paper and invalid sheets of paper.

57. An apparatus according to claim 53, wherein said transporting means is controlled to transport sheets of paper from said port means to said counting means for discrimination between sheets of paper, and to transport valid sheets of paper from said counting means to said accommodating means.

58. An apparatus according to claim 53, wherein said counting means comprises a counter portion to discriminate between valid sheets of paper and invalid sheets of paper, a first stack portion for temporarily stacking the valid sheets of paper, and a second stack portion for temporarily stacking the invalid sheets of paper, said transporting means being controlled to transport the valid sheets of paper from said first stack portion to said accommodating means.

59. An apparatus for handling sheets of paper, comprising:

port means through which the sheets of paper are put in and taken out of said apparatus;

accommodating means for accommodating the sheets of paper both put into and to be taken out of said apparatus;

counting means for counting the sheets of paper put in and to be taken out;

transporting means including a hand traveling along a first axis between said port means, said accommodating means and said counting means, and traveling along a second axis obliquely transversing said first axis to reach the sheets of paper at said port means, said accommodating means and said counting means, and moving about a third axis disposed to obliquely transverse the second axis, for transporting the sheets of paper between said port means, said accommodating means and said counting means; and control means for controlling the operation of said counting means and the travel of said transporting means between said port means, accommodating means and counting means;

wherein the movement of said transporting means is controllable by said control means to transport to said accommodating means via said counting means the sheets of paper put into the port means, and to transport to said port means via said counting means sheets of paper stored in said accommodating means including the sheets of paper transported to said accommodating means by said transporting means, whereby sheets of paper received by said apparatus from one customer during one transaction may by dispensed by the apparatus to another customer during a subsequent transaction.

60. An apparatus according to claim 59, wherein said counting means is adapted to discriminate between the sheets of paper transported by said transporting means and to divide the sheets of paper into valid sheets of paper and invalid sheets of paper.

61. An apparatus according to claim 60, wherein said transporting means is controlled to transport the valid sheets of paper from said counting means to said accommodating means whereby the valid sheets of paper are retained for dispensing through the port means via the counting means during a subsequent transaction.

62. An apparatus according to claim 61, wherein said transporting means is controlled by said controlling means to transport the valid sheets of paper from said accommodating means to said port means via said counting means and thereby dispense the valid sheets of paper from said apparatus.

63. An apparatus according to claim 60, wherein said transporting means is controlled to transport sheets of paper put in through said port means to said counting means for discrimination between valid sheets of paper and invalid sheets of paper.

64. An apparatus according to claim 60, wherein said transporting means is controlled to transport sheets of paper from said port means to said counting means for discrimination between sheets of paper, and to transport valid sheets of paper from said counting means to said accommodating means.

65. An apparatus according to claim 60, wherein said counting means comprises a counter portion to discriminate between valid sheets of paper and invalid sheets of paper, a first stack portion for temporarily stacking the valid sheets of paper, and a second stack portion for temporarily stacking the invalid sheets of paper, said transporting means being controlled by said controlling means to transport en bloc the valid sheets of paper from said first stack portion to said accommodating means.

66. An apparatus for handling sheets of paper, comprising:

a port for receiving both single sheets and a plurality of sheets of paper during a deposit transaction and for discharging both single sheets and a plurality of sheets of paper during a dispensing transaction;

a first station for holding a plurality of sheets of paper;

a second station for holding a plurality of sheets of paper;

a third station for holding a plurality of sheets of paper;

a counting station disposed between said first and second stations and between said first and third stations, for counting and for performing discriminations between sheets of paper received from said first station, and for dividing the sheets of paper between the second and third stations on the basis of the discriminations;

a fourth station for storing sheets of the paper between the transactions;

means for transporting en bloc the sheets of paper among said port, first station, second station, third station and fourth station; and control means for controlling said transporting means to hand the sheets of paper to said first station from either one of said port and said fourth station and to separately received counted sheets of paper from either one of said second and third stations and further for controlling to transport said counted sheets of paper from either one of said second and third stations to either one of said port and said fourth station.

67. An apparatus according to claim 66, wherein said counting station comprises a receiving portion disposed adjacent the first station for receiving the sheets of paper, a counting portion for counting each of the sheets of paper, and a releasing portion for releasing to the second and third stations the sheets of paper counted by said counting portion, whereby the sheets of paper are handed to said first station by said transporting means and the counted sheets of paper are separately taken en bloc from said second station and third station by said transporting means.

68. An apparatus according to claim 67, wherein said receiving portion, and said first, second and third stations are arranged on the same side of said counting means.

69. An apparatus according to claim 67, wherein said first, second, third and fourth station are arranged along a path of travel of said transporting means.

70. An apparatus according to claim 67, wherein said first, second and third stations are arranged along a path of travel of said transporting means between said port and fourth station.

71. An apparatus according to claim 67, wherein said control means positions said transporting means at a home position facing said counting station prior to a first phase of a dispensing transaction.

72. An apparatus according to claim 67, wherein said control means directs said transporting means to travel directly from a rest position to an intermediate position facing said counting station during a first phase of a dispensing transaction.

73. An apparatus according to claim 66, wherein said transporting means comprises a first carrier transporting exclusively the sheets of paper between said port and said first station, and a second carrier transporting exclusively the sheets of paper between said third station and said fourth station.

74. An apparatus according to claim 73, wherein said first carrier comprises a first robot hand traveling along a first axis between said port and said first station and traveling along a second axis obliquely transversing said first axis to grasp and retain the sheets of paper at said port and said first station; and said second carrier comprises a second robot hand traveling along said first axis between said third and said fourth station and traveling along said second axis to grasp and retain the sheets of paper at said third station and said fourth station.

75. An apparatus according to claim 73, wherein the first carrier comprises a first robot hand traveling between said port and said first station to grasp and retain en bloc the sheets of paper at said port and said first station; and said second carrier comprises a second robot hand traveling between said third station and said fourth station to grasp and retain en bloc the sheets of paper at said third station and said fourth station.

76. An apparatus according to claim 66, wherein said first, second, third and fourth stations are disposed along a path of travel of said transporting means.

77. An apparatus according to claim 76, wherein said first, second, third and fourth stations are disposed vertically along the path of travel of said transporting means, whereby said transporting means travels vertically to transport the sheets of paper en bloc along said path.

78. An apparatus according to claim 66, wherein each of said port and fourth stations has a single common orifice for receiving and dispensing the sheets of paper.

79. An apparatus according to claim 66, wherein said transporting means has two moving paths, at least one of said port and said stations is disposed on the opposite side of one of said paths from the other of said port and said stations and said transporting means moves along said second moving path to transport the sheets of paper between said port and said stations.

80. An apparatus according to claim 66, wherein said transporting means is controlled to be at a home position facing said port prior to a first phase of a deposit transaction.

81. An apparatus for handling sheets of paper, comprising:

port means providing a single orifice at a first station through which the sheets of paper are put into the apparatus during a deposit transaction and taken out of said apparatus during a dispensing transaction;

accommodating means located at a second station for accommodating storage of sheets of paper both put into and to be taken out of said apparatus;

counting means formed independently of said accommodating means and including a third station receiving and storing stacks of sheets of paper to be counted and a plurality of spaced apart other stations separately receiving and storing stacks of sheets of paper, for counting both sheets of paper put into and to be taken out of the apparatus, for performing discriminations between sheets of paper, and for dividing the sheets of paper between the other stations on the basis of the discriminations into sheets of paper to be dealt with and sheets of paper not to be dealt with;

transporting means defining a path of travel between said first, second, third and plurality of other stations, for transporting en bloc sheets of paper in both directions between said accommodating means and said counting means; and control means for controlling the operation of said counting means to divide the sheets of paper during a deposit transaction with sheets of paper not to be dealt with going to a first one of said other stations closest along the path of travel to said first station, and to divide the sheets of paper during a dispensing transaction with sheets of paper to be dealt with going to said first one of said other stations, and controlling said transporting means during a deposit transaction to transport en bloc between said counting means and said accommodating means sheets of paper to be dealt with and during a dispensing transaction to transport en bloc between said accommodating means and said third station sheets of paper to be counted.

82. An apparatus according to claim 81, wherein said transporting means is controlled to transport to said accommodating means sheets of paper counted in said counting means and to transport to said counting means sheets of paper stored in said accommodating means including the sheets of paper transported to said accommodating means by said transporting means, whereby the sheets of paper received by said apparatus from one customer during one transaction may be dispensed by the apparatus to another customer during a subsequent transaction.,

83. An apparatus for handling sheets of paper, comprising:

port means through which sheets of paper are put into and taken out of said apparatus;

accommodating means formed separately of said port means as a discrete element for accommodating the sheets of paper both put into and taken out of said apparatus;

single counting means formed as a discrete element separate from said accommodating means, for cooperating with both said port means and said accommodating means by counting the sheets of paper put into and to be taken out from the apparatus;

transporting means formed separately from said port means, accommodating means and counting means for cooperating with said port means, accommodating means and counting means by transporting the sheets of paper along a path among said port means, said accommodating means and said counting means; and control means for controlling the operation of said counting means and said transporting means;

wherein said port means, accommodating means and counting means are disposed along the path of said transporting means.

84. An apparatus according to claim 83, wherein said port means, accommodating means and counting means are disposed vertically along the path of travel of said transporting means whereby said transporting means travels vertically while transporting the sheets of paper.

85. An apparatus according to claim 83, wherein said counting means comprises a receiving portion for receiving the sheets of paper, a counting portion for counting each of the sheets of paper, and a releasing portion for releasing counted sheets of paper conveyed from said counting portion, said receiving, counting and releasing portions being disposed along a path of travel of said transporting means.

86. An apparatus according to claim 85, wherein said receiving portion, counting portion and releasing portion are disposed vertically along the path of travel of said transporting means, whereby said transporting means travels vertically while transporting the sheets of paper.

87. An apparatus for handling sheets of paper, comprising:

a first station through which the sheets of paper are put into and taken out of said apparatus;

a second station for accommodating the sheets of paper both put into and to be taken out of said apparatus;

counting station for counting the sheets of paper put into and to be taken out of said apparatus;

transporting means for transporting the sheets of paper along a path of travel among said first station, said second station and said counting station; and control means for controlling the operation of said counting station and transporting means;

wherein said transporting means, said control means and each station is independently formed, and one of said first station and counting station is disposed on the same side of said path of travel as said second station.

88. An apparatus according to claim 87, wherein one of said first station and counting station is located on the opposite side of said path of travel from said second station.

89. An apparatus for handling sheets of paper, comprising:

a first station providing a single port through which sheets of paper may be put into the apparatus by a customer and dispensed by the apparatus to a customer;

a second station for accommodating storage of the sheets of paper both put into and to be taken out of said apparatus;

a counting station for counting, making discriminations between and sorting on the basis of said discriminations the sheets of paper put into and to be dispensed by said apparatus;

transporting means for transporting the sheets of paper en bloc along a path of travel among said first station, said second station and said counting station; and control means for controlling the operation of said counting station and transporting means;

said first station, second station, counting station, said transporting means and said control means being formed as separate units constructed independently, and one of said first station and counting station being disposed on the same side of said transporting means as said second station.

90. An apparatus according to claim 89, wherein one of said first station and counting station is located on the opposite side of said path of travel from said second station.

91. An apparatus according to claim 89, wherein said first station and said counting station are spaced apart by a predetermined gap with said transporting means disposed within said gap between said first station and said counting station, said transporting means providing the only means for transporting sheets of paper between all of said first station, second station and counting station.

92. An apparatus for handling sheets of paper, comprising:

port means through which sheets of paper are handled;

accommodating means for accommodating the sheets of paper handled and to be handled;

counting means independently formed from said accommodating means, for counting the sheets of paper handled and to be handled;

transporting means for transporting the sheets of paper en bloc between said accommodating means, said port means and said counting means; and control means for controlling the operation of said counting means and said transporting means.

93. An apparatus for handling sheets of paper, comprising:

port means through which sheets of paper are put into and taken out of said apparatus;

accommodating means for accommodating the sheets of paper put into and to be taken out of said apparatus;

single counting means common to both said port means and accommodating means for counting and discriminating between the sheets of paper put into and to be taken out of said apparatus;

transporting means for transporting the sheets of paper en bloc between said port means and said single counting means; and control means for controlling the operation of said counting means and said transporting means.

94. An apparatus for handling sheets of paper, comprising:

port means through which sheets of paper are handled;

single accommodating means for accommodating the sheets of paper handled and to be handled;

single counting means common to both said port means and said single accommodating means for counting the sheets of paper handled and to be handled;

transporting means for transporting the sheets of paper en bloc between said single accommodating means, and said single counting means; and control means for controlling the operation of said single counting means and said transporting means.

95. An apparatus for handling sheets of paper, comprising:

port means through which sheets of paper are put into and taken out of said apparatus;

single accommodating means for accommodating the sheets of paper put into and to be taken out of said apparatus;

single counting means common to both said port means and accommodating means for counting and discriminating between the sheets of paper put into and to be taken out of said apparatus;

transporting means for transporting the sheets of paper en bloc among said port means, said accommodating means, and said counting means; and control means for controlling the operation of said counting means and said transporting means;

wherein the movement of said transporting means is controllable by said control means to transport the sheets of paper put into and to be taken out of said apparatus, among said port means and said accommodating means via said counting means.

96. An apparatus for handling sheets of paper, comprising:

port means through which sheets of paper are handled;

accommodating means for accommodating the sheets of paper handled and to be handled;

counting means independently formed from said accommodating means and including a receiving portion temporarily storing a stack of sheets of paper prior to counting and a stack portion temporarily storing stacks of sheets of paper after counting, for counting and discriminating between the sheets of paper handled and to be handled;

transporting means for transporting the sheets of paper en bloc among said accommodating means, said receiving portion and said stack portion; and control means for controlling the operation of said counting means and said transporting means.

97. An apparatus for handling sheets of paper, comprising:

port means through which sheets of paper are put into and taken out of said apparatus;

accommodating means for accommodating the sheets of paper put into and to be taken out of said apparatus;

counting means common to both said port means and accommodating means and including a receiving portion temporarily storing a stack of sheets of paper prior to counting and a stack portion temporarily storing stacks of sheets of paper after counting, for counting the sheets of paper put into and to be taken out of said apparatus;

transporting means for transporting the sheets of paper en bloc among said port means, said accommodating means, said receiving portion and said stack portion; and control means for controlling the operation of said transporting means;

wherein the movement of said transporting means is controllable by said control means to transport the sheets of paper put into and to be taken out of said apparatus, among said port means and said accommodating means via said counting means.

98. An apparatus for handling sheets of paper, comprising:

port means through which sheets of paper are put into and taken out of said apparatus;

accommodating means for accommodating the sheets of paper into and to be taken out of said apparatus;

single counting means common to both said port means and accommodating means and including a receiving portion temporarily storing a stack of sheets of paper prior to counting and a stack portion temporarily storing a stack of sheets of paper after counting, for counting and discriminating the sheets of paper put into and to be taken out of said apparatus;

transporting means for transporting the sheets of paper en bloc among said port, said accommodating means, said receiving portion and said stack portion; and control means for controlling the operation of said counting means and said transporting means.

99. An apparatus for handling sheets of paper, comprising:

port means through which sheets of paper are put into and taken out of said apparatus;

accommodating means for accommodating the sheets of paper put into and to be taken out of said apparatus;

counting means common to both said port means and accommodating means and including a receiving portion temporarily storing a stack of sheets of paper prior to counting and a stack portion temporarily storing a stack of sheets of paper after counting, for counting the sheets of paper put into and to be taken out of said apparatus;

transporting means for transporting the sheets of paper en bloc among said port means, said accommodating means, said receiving portion and said stack portion; and control means for controlling the operation of said transporting means;

wherein the movement of said transporting means is controllable by said control means to transport the sheets of paper put into and to be taken out of said apparatus, from said port means to said receiving portion of said counting means and from said stack portion of said counting means to said port means, respectively.

100. An apparatus for handling sheets of paper, comprising:

port means through which sheets of paper are put into and taken out of said apparatus;

accommodating means for accommodating the sheets of paper put into and to be taken out of said apparatus;

counting means common to both said port means and accommodating means, for counting the sheets of paper put into and to be taken out of said apparatus;

transporting means for transporting the sheets of paper en bloc among said port means, said accommodating means, said counting means; and control means for controlling the operation of said counting means and said transporting means;

said transporting means being controlled by said control means to move among said port means, said accommodating means and said counting means to transport the sheets of paper, and to approach said port means, said accommodating means and said counting means to hand and receive the sheets of paper.

101. An apparatus for handling sheets of paper, comprising:

port means through which sheets of paper are put into and taken out of said apparatus;

accommodating means for accommodating the sheets of paper put into and to be taken out of said apparatus;

counting means common to both said port means and accommodating means for counting the sheets of paper put into and to be taken out of said apparatus;

transporting means for transporting the sheets of paper en bloc among said port means, said accommodating means, said counting means; and control means for controlling the operation of said counting means and said transporting means;

said port means, said accommodating means and said counting means being aligned vertically along the path of travel of said transporting means.

102. An apparatus for handling sheets of paper, comprising:

port means through which sheets of paper are put into and taken out of said apparatus;

accommodating means for accommodating the sheets of paper put into and to be taken out of said apparatus;

counting means common to both said port means and accommodating means for counting the sheets of paper put into and to be taken out of said apparatus;

transporting means for transporting the sheets of paper en bloc among said port means, said accommodating means, and said counting means; and control means for controlling the operation of said counting means and said transporting means;

said port means, said accommodating means and said counting means being aligned vertically along the path of travel of said transporting means, said transporting means being controlled by said control means to transport the sheets of paper put into said port means to said accommodating means, and the sheets of paper to be taken out from said accommodating means to said port means via said counting means.

103. A manipulator for handling sheets of paper, comprising:

a body with a pair of fingers disposed on said body for opening and closing relative to a first axis, and a first actuator disposed on said body for operating said pair of fingers to open and to close, for grasping and releasing a plurality of sheets of paper; and a transfer assembly including:

a table supporting and enabling said body to slide along a second axis and to rotate about a third axis, a vertical operating mechanism moving said table vertically along a fourth axis transverse to said second axis, a second actuator for sliding said body along the second axis, a third actuator for rotating said body about the third axis, and a fourth actuator for moving said table vertically along the fourth axis.

104. An apparatus for handling sheets of paper, comprising:

port means through which sheets of paper are put into and taken out of said apparatus;

accommodating means for accommodating the sheets of paper put into and to be taken out of said apparatus;

single counting means common to both said port means and accommodating means and including a receiving portion temporarily storing a stack of sheets of paper prior to counting and a stack portion temporarily storing stacks of sheets of paper after counting, for counting the sheets of paper put into and to be taken out of said apparatus;

transporting means for transporting the sheets of paper en bloc among said port means, said accommodating means, said receiving portion and said stack portion; and control means for controlling the operation of said counting means and said transporting means;

wherein the movement of said transporting means is controllable by said control means to transport the sheets of paper put into and to be taken out of said apparatus, among said port means and said accommodating means via said counting means.

105. An apparatus for handling sheets of paper, comprising:

an accommodating section for accommodating sheets of paper between discharging transactions;

a counting section for discriminating between and counting said sheets of paper and for dividing said sheets of paper between those to be dealt with and those not to be dealt with during discharging transactions;

a port section through which said sheets of paper are taken out of said apparatus during discharging transactions;

a transporting section for taking out said sheets of paper from said accommodating section and delivering the same to said counting section in a discharging transaction, and for during a discharging transaction, transporting en bloc said sheets of paper to be dealt with from said counting section to said port section;

a control section for controlling said counting section and said transporting section according to a predetermined program;

wherein said transporting section includes a hand portion for grasping and releasing en bloc said sheets of paper at predetermined positions relative to said sections, and a transferring portion for transferring said hand portion to the predetermined positions, said hand portion taking out en bloc in the discharging transaction a suitable number of said sheets of paper from said accommodating section.

106. An apparatus for handling sheets of paper, comprising:

a single port providing a first terminus permitting customers during a deposit transaction to put sheets of paper into and during a dispensing transaction to remove sheets of paper from said apparatus;

accommodating means including a second terminus, for accommodating storage of sheets of paper between transactions and for accommodating passage of sheets of paper at said second terminus during said transactions;

single counting means accessible to sheets of paper from both said port and said accommodating means and providing a third terminus receiving and storing sheets of paper and other termini storing sheets of paper, for counting, discriminating between sheets of paper and dividing said sheets of paper among said other termini on the basis of said discriminating into sheets of paper to be dealt with and sheets of paper not to be dealt with; and transporting means for distributing sheets of paper en bloc among said port, accommodating means and counting means during both deposit and dispensing transactions, said second, third and other termini being arranged in a vertical row along a path of travel by said transporting means to enable said conveying means to obtain sheets of paper at said termini and to distribute sheets of paper en bloc among said accommodating means and counting means as said transporting means travels along the path;

wherein said transporting means moves sheets of paper between said port and said accommodating means via said counting means and between said accommodating means and said port via counting means according to the type of transaction.

107. A method for handling sheets of paper in apparatus with port means, counting means, accommodating means for accommodating sheets of paper, and transporting means movable therebetween for transporting sheets of paper, comprising the steps of:

(1) transporting en bloc sheets of paper to said counting means by means of said transporting means;

(2) counting and discriminating between the sheets of paper transported in step (1); and (3) transporting en bloc the sheets of paper subjected to the counting and discriminating step (2) to either of said port means and said accommodating means by means of said transporting means.

108. A method for handling sheets of paper in apparatus with port means, counting means, accommodating means for accommodating sheets of paper, and transporting means movable therebetween for transporting sheets of paper, comprising the steps of:

(1) taking out en bloc the sheets of paper from a predetermined one of said port means and said accommodating means and transporting the sheets of paper taken out to said counting means by means of said transporting means;

(2) counting and discriminating between the sheets of paper taken out in the step (1) by means of said counting means; and (3) transporting en bloc the sheets of paper subjects to the counting and discriminating step (2) to a predetermined one of said accommodating means and said port means by means of said transporting means.

109. A method for handling sheets of paper in apparatus with port means, counting means, accommodating means for accommodating sheets of paper, and transporting means movable therebetween for transporting sheets of paper, comprising the steps of:

(1) taking out en bloc the sheets of paper from said port means and transporting en bloc the sheets of paper taken out to said counting means by means of said transporting means;

(2) counting and discriminating the sheets of paper taken out and transported in the step (1); and (3) transporting en bloc the sheets of paper subjected to the counting and discriminating step (2) from said counting means to said accommodating means by means of said transporting means.

110. A method for handling sheets of paper in apparatus with port means, counting means, accommodating means for accommodating sheets of paper and transporting means movable therebetween for transporting sheets of paper, comprising the steps of:

(1) taking out en bloc the sheets of paper from said accommodating means and transporting en bloc the sheets of paper taken out to said counting means by means of said transporting means;

(2) counting and discriminating between the sheets of paper taken out and transported in the step (1); and (3) transporting en bloc the sheets of paper subjected to the counting and discriminating step (2) from said counting means to said port means by means of said transporting means.

111. A method for handling sheets of paper in apparatus with port means, accommodating means for accommodating sheets of paper, counting means having at least first, second and third storing positions, and transporting means movable therebetween for transporting sheets of paper, comprising the steps of:

(1) taking out en bloc sheets of paper from a predetermined one of said port means and said accommodating means and transporting the sheets of paper taken out to said counting means by means of said transporting means;

(2) storing the sheets of paper taken out and transported in the step (1) temporarily at said first storing position;

(3) counting and discriminating between the sheets of paper stored in the step (2) to be conveyed to a predetermined one of said second and third storing positions on the basis of said discriminating by means of said counting means;

(4) moving said transporting means to a predetermined one of said second and third storing positions during step (3); and (5) taking en bloc the sheets of paper at the predetermined one of said storing positions and transporting them to a predetermined one of said accommodating means and said port means by means of said transporting means.

112. A method for handling sheets of paper in apparatus with port means, accommodating means for accommodating sheets of paper, counting means having at least first, second and third storing positions, and transporting means movable therebetween for transporting sheets of paper, comprising the steps of:

(1) taking out en bloc sheets of paper from said accommodating means and transporting the sheets of paper taken out to said counting means by means of said transporting means;

(2) storing the sheets of paper taken out in the step (1) temporarily at said first storing position;

(3) counting the sheets of paper stored in the step (2) to be conveyed to a predetermined one of said second and third storing positions on the basis of said counting by means of said counting means;

(4) moving said transporting means to a predetermined one of said second and third storing positions during step (3); and (5) taking en bloc the sheets of paper at said predetermined one of said storing positions and transporting them to said port means by means of said transporting means.

113. A method for handling sheets of paper in apparatus with port means, accommodating means for accommodating sheets of paper, counting means having first, second and third storing positions, and transporting means movable therebetween for transporting sheets of paper, comprising the steps of:

(1) taking out en bloc sheets of paper from said port means and transporting the sheets of paper taken out to said counting means by means of said transporting means;

(2) storing the sheets of paper taken out in the step (1) temporarily at said first storing position;

(3) counting and discriminating between the sheets of paper stored in the step (2) to be conveyed to said second and third storing positions on the basis of said discriminating by means of said counting means;

(4) moving said transporting means to a predetermined one of said second and third storing positions during step (3); and (5) taking and transporting en bloc the sheets of paper stored at said predetermined one of said storing positions to said accommodating means by means of said transporting means.

114. A method for handling sheets of paper in apparatus with port means, accommodating means for accommodating sheets of paper, counting means having first, second and third storing positions, and transporting means movable therebetween for transporting sheets of paper, comprising the steps of:

(1) taking out en bloc uncounted sheets of paper from a predetermined one of said port means and said accommodating means and transporting the sheets of paper taken out to said counting means by means of said transporting means;

(2) storing the sheets of paper taken out in the step (1) temporarily at said first storing position;

(3) counting and discriminating between the sheets of paper stored in the step (2) to be conveyed to a predetermined one of said second and third storing positions on the basis of said discriminating by means of said counting means;

(4) moving said transporting means to a predetermined one of said second and third storing positions during step (3); and (5) taking and transporting en bloc the counted and discriminated sheets of paper at a predetermined one of said storing positions to a predetermined one of said accommodating means and said port means by means of said transporting means.

115. A method for handling sheets of paper in apparatus with port means, counting means, accommodating means for accommodating sheets of paper, and transporting means movable therebetween for transporting sheets of paper, comprising the steps of:

(1) taking out en bloc uncounted and undiscriminated sheets of paper from said port means by means of said transporting means;

(2) transporting en bloc the sheets of paper taken out in the step (1) to said counting means;

(3) counting and discriminating between the sheets of paper transported in the step (2); and (4) transporting en bloc the sheets of paper counted and discriminated in the step (3) from said counting means to said accommodating means by means of said transporting means.

116. A method for handling sheets of paper in apparatus with pot means, counting means, accommodating means for accommodating sheets of paper, and transporting means movable therebetween for transporting sheets of paper, comprising the steps of:

(1) taking out en bloc uncounted sheets of paper from said accommodating means by means of said transporting means;

(2) transporting en bloc the sheets of paper taken out in the step (1) to said counting means;

(3) counting and discriminating between the sheets of paper transported in the step (2); and (4) transporting en bloc the sheets of paper subjected to the counting and discriminating step (3) from said counting means to said port means by means of said transporting means.

117. An apparatus for handling sheets of paper, comprising:

a single port providing a first terminus permitting customers during a deposit transaction to put sheets of paper into and during a dispensing transaction to remove sheets of paper from said apparatus;

accommodating means including a second terminus, for accommodating storage of sheets of paper between transactions and for accommodating passage of sheets of paper at said second terminus during said transactions;

single counting means accessible to sheets of paper from both said port and said accommodating means and providing a third terminus receiving and storing sheets of paper and other termini storing sheets of paper, for counting, discriminating between sheets of paper and dividing said sheets of paper among said other termini on the basis of said discriminating into sheets of paper to be dealt with and sheets of paper not to be dealt with, during both deposit and dispensing transactions; and conveying means for distributing sheets of paper en bloc among said port, accommodating means and counting means during both deposit and dispensing transactions, said first, second, third and other termini being arranged along a path of travel by said conveying means to enable conveying means to obtain sheets of paper at said termini and to distribute sheets of paper en bloc among said accommodating means and counting means as said conveying means travels along the path;

wherein said conveying means moves sheets of paper between said port and said accommodating means via said counting means and between said accommodating means and said port via said counting means according to the type of transaction.

118. An apparatus for handling sheets of paper, comprising:

port means providing a single orifice through which the sheets of paper are put in and taken out of said apparatus;

accommodating means for accommodating the sheets of paper both put in and taken out of said apparatus;

single counting means common to both said port means and said accommodating means, said counting means including a plurality of spaced apart, separate locations for storing sheets of paper, for counting, discriminating between, sorting into stacks on the basis of said discriminating, and storing said stacks at said separate locations, the sheets of paper put in and to be taken out of the apparatus via said orifice;

transporting means for transporting the sheets of paper both singly and en bloc among said orifice, said accommodating means, said counting means and said plurality of locations; and control means for controlling the operation of said counting means and said transporting means;

wherein movement of said transporting means is controllable by said control means to transport to said accommodating means via said counting means the sheets of paper put into the port means, and to transport to said port means via said counting means sheets of paper stored in said accommodating means including sheets of paper transported to said accommodating means by said transporting means, whereby the sheets of paper received by said apparatus during one transaction may be dispensed by the apparatus during a subsequent transaction.

119. An apparatus for handling sheets of paper, comprising:

first port means through which the sheets of paper are put into and taken out of the apparatus;

accommodating means for accommodating sheets of paper both put into and to be taken out of said apparatus;

single common counting means including a plurality of spaced apart, separate locations for storing sheets of paper, for counting and sorting each sheet of paper put into and to be taken out of the apparatus, and for storing at said separate locations a plurality of different types of sheets of paper sorted by the counting means;

transporting means for transporting a plurality of sheets of paper between said first port means, and any one of said accommodating means, said counting means and said separate locations; and control means for controlling the operation of said counting means and said transporting means, wherein said transporting means is controlled by said control means to transport the sheets of paper put into and to be taken out of said apparatus, between said port means and said accommodating means through said counting means, said transporting means comprising a first robot hand traveling between said port means and said counting means to grasp and retain the sheets of paper at said counting means and said accommodating means; and a second robot hand traveling between said counting means and said accommodating means to grasp and retain the sheets of paper at said counting means and said accommodating means.

* * * * *